US005423088A

United States Patent [19]

Walker et al.

[11] Patent Number: 5,423,088

[45] Date of Patent: * Jun. 13, 1995

[54] INFLATABLE GAME GLOVES

[75] Inventors: Alan D. Walker, Somers, Conn.; David P. Chastain, Acton, Mass.; Harvey A. Koselka, Somerville, Mass.; Andrew Jones, Roslindale, Mass.

[73] Assignee: Lisco, Inc., Tampa, Fla.

[ * ] Notice: The portion of the term of this patent subsequent to Oct. 20, 2009 has been disclaimed.

[21] Appl. No.: 955,191

[22] Filed: Oct. 1, 1992

Related U.S. Application Data

[63] Continuation-in-part of Ser. No. 803,279, Dec. 5, 1991, Pat. No. 5,155,866, which is a continuation-in-part of Ser. No. 728,476, Jul. 11, 1991, Pat. No. 5,155,865, which is a continuation-in-part of Ser. No. 690,206, Apr. 23, 1991, Pat. No. 5,155,864.

[51] Int. Cl.[6] ..... A41D 13/08

[52] U.S. Cl. ..... 2/19; 2/159; 2/DIG. 3

[58] Field of Search ..... 2/19, 18, 161 A, 159, 2/DIG. 3, 413; 36/28, 29, 35 R, 35 B, 71, 89, 73, 88, 92, 114, 115, 119, 91, 117

[56] References Cited

U.S. PATENT DOCUMENTS

| | | | |
|---|---|---|---|
| D. 280,462 | 9/1985 | Aoki . | |
| D. 300,182 | 3/1989 | Aoki . | |
| D. 310,739 | 9/1990 | Clevenhagen . | |
| D. 315,620 | 3/1991 | Latina . | |
| 320,972 | 6/1885 | Rumsy . | |
| 450,717 | 4/1891 | Reach | 2/19 |
| 531,872 | 1/1895 | Shibe . | |
| 570,092 | 10/1896 | Harvey . | |
| 600,779 | 8/1898 | Frazier . | |
| 746,338 | 12/1903 | Keen . | |
| 812,921 | 2/1906 | Decker | 2/19 |
| 972,224 | 10/1910 | Pease . | |
| 1,053,204 | 2/1913 | Morrison . | |
| 1,362,280 | 12/1920 | Young | 2/19 |
| 1,465,223 | 8/1923 | Kobbe | 2/19 |
| 1,602,027 | 10/1926 | Kennedy | 2/19 |
| 1,622,322 | 3/1927 | Kennedy . | |
| 1,954,122 | 4/1934 | Fiori . | |
| 1,974,616 | 9/1934 | Kirkham | 2/19 |
| 2,135,853 | 11/1938 | Slizus . | |
| 2,275,206 | 3/1942 | Sutherland . | |
| 2,638,690 | 5/1953 | Bullard . | |
| 2,653,319 | 9/1953 | Slizus . | |
| 2,744,152 | 8/1956 | White . | |
| 2,817,088 | 12/1957 | Vrana . | |
| 2,830,585 | 4/1958 | Weiss | 36/71 |
| 2,842,771 | 7/1958 | Foti . | |
| 2,881,445 | 4/1959 | Vrana . | |
| 2,981,010 | 4/1961 | Aaskov . | |
| 3,217,333 | 11/1965 | Sweet . | |
| 3,602,915 | 9/1971 | Collins . | |
| 3,605,117 | 9/1971 | Latina . | |
| 3,623,163 | 11/1971 | Latina . | |
| 3,664,043 | 5/1972 | Polunbus . | |
| 3,685,176 | 8/1972 | Rudy | 36/71 |
| 3,841,304 | 10/1974 | Jones . | |
| 3,854,228 | 12/1974 | Conroy . | |
| 3,926,175 | 12/1975 | Allen . | |
| 4,067,063 | 1/1978 | Ettinger . | |

(List continued on next page.)

FOREIGN PATENT DOCUMENTS

| | | |
|---|---|---|
| 0298449 | 11/1989 | European Pat. Off. . |
| 3326085 | 7/1983 | Germany . |

(List continued on next page.)

*Primary Examiner*—Clifford D. Crowder
*Assistant Examiner*—Gloria Hale

[57] ABSTRACT

An improved game glove including a front portion and a back portion defining a hand space therebetween and forming a major region for receiving the fingers of the wearer and a minor region for receiving the thumb of the wearer; an opening at one edge of the glove for the passage of the hand of a wearer into the hand space; a bladder positioned in the hand space, the bladder having a major portion in the major region of the glove and a minor portion in the minor region for the glove; and an inflation system to selectively inflate the bladder the inflation system including a pump system having a diaphragm for selectively inflating the bladder to improve the fit of the glove on a wearer's hand, the pump system also including a tube coupling the diaphragm and the bladder.

11 Claims, 29 Drawing Sheets

U.S. PATENT DOCUMENTS 4,128,951 12/1978 Tansill .
4,192,018 3/1980 Latina .
4,232,459 11/1980 Vaccari .
4,346,481 8/1982 Latina .
4,358,902 11/1982 Cole .
4,361,969 12/1982 Vermonet .
4,370,754 2/1983 Donzis .
4,397,104 8/1983 Doak .
4,446,634 5/1984 Johnson .
4,449,520 5/1984 Palomar .
4,453,271 6/1984 Donzis .
4,453,272 6/1984 Miyake et al. ..... 2/19
4,477,927 10/1984 Tsubota .
4,483,022 11/1984 Aoki .
4,486,975 12/1984 Harreld .
4,527,287 7/1985 Aoki ..... 2/19
4,611,584 9/1986 Finney .
4,643,733 3/1987 Becker .
4,651,345 3/1987 Latina .
4,702,022 10/1987 Porcher .
4,712,316 12/1987 Baggio .
4,730,403 3/1988 Walkhoff ..... 36/119
4,763,426 8/1988 Polus .
4,846,784 7/1989 Haber .
4,847,915 7/1989 Keen .
4,852,287 8/1989 Martin .
4,853,975 8/1989 Clevenhagen ..... 2/19
4,887,367 12/1989 Mackness .
4,908,880 3/1990 Clevenhagen .
4,912,861 4/1990 Huang .
4,937,882 7/1990 Hayes .
4,947,486 8/1990 Hsuih .
4,995,173 2/1991 Spier .
4,999,932 3/1991 Grim .
5,075,899 12/1991 Funahashi .
5,113,599 5/1992 Cohen .
5,155,864 10/1992 Walker et al. ..... 2/19
5,155,865 10/1992 Walker et al. ..... 2/19
5,155,866 10/1992 Walker et al. ..... 2/19

FOREIGN PATENT DOCUMENTS 3427644 1/1986 Germany .
3600437 7/1987 Germany ..... 36/117
1037730 of 1986 Japan .
1037685 10/1986 United Kingdom .
1037728 10/1986 United Kingdom .
1037729 10/1986 United Kingdom .
1037730 10/1986 United Kingdom .
1037732 of 1987 United Kingdom .
1044026 8/1987 United Kingdom .
1044027 8/1987 United Kingdom .
1044028 8/1987 United Kingdom .
1044029 8/1987 United Kingdom .
1044030 8/1987 United Kingdom .
1044031 8/1987 United Kingdom .
1044032 8/1987 United Kingdom .
1044033 8/1987 United Kingdom .
1056365 1/1989 United Kingdom .
2000086 8/1989 United Kingdom .
2000087 8/1989 United Kingdom .
2000234 8/1989 United Kingdom .
2003612 12/1989 United Kingdom .
2009886 2/1991 United Kingdom .
2009888 2/1991 United Kingdom .
2009889 2/1991 United Kingdom .
2009890 2/1991 United Kingdom .
2009887 4/1991 United Kingdom .
2005392 7/1991 United Kingdom .
2013013 8/1991 United Kingdom .
9004323 5/1990 WIPO .
9009115 8/1990 WIPO .

INFLATABLE GAME GLOVES

RELATED APPLICATION

This application is a continuation-in-part application of U.S. patent application Ser. No. 07/803,279 filed Dec. 5, 1991, now U.S. Pat. No. 5,155,866 which, in turn, is a continuation-in-part of U.S. patent application Ser. No. 07/728,476 filed Jul. 11, 1991 now U.S. Pat. No. 5,155,865 which, in turn, is a continuation-in-part application of U.S. patent application Ser. No. 07/690,206 filed Apr. 23, 1991, now U.S. Pat. No. 5,155,864.

BACKGROUND OF THE INVENTION

1. Field of the Invention

This invention relates to inflatable game gloves and, more particularly, to baseball or softball gloves having bladders which are selectively inflatable.

2. Description of the Background Art

The technology for game gloves, whether for baseball, softball or the like involves a glove particularly sized and configured for the preference of the player. Human factors involved with glove design relate to a plurality of factors. One human factor, hand motion, includes two ways for closing the hand. The thumb to the index finger, a natural motion which is the strongest motion. In the alternative, the thumb can move to the ring finger, the traditional glove closing motion. Strength is effected by the finger position. Two fingers are stronger than one, but there is less strength when the fingers are spread apart.

Another human factor relates to the flex points on the hand. The palm has two flex points, the first is across the palm about ½ inch below the base of the fingers. The second begins at the base of the index finger around the thumb. These flex points create a wide wedge when using the natural hand motion and a narrow wedge with the traditional hand motion. The back of the hand also has flex lines, a first is across the knuckles and a second begins about ½ inch outside of the index finger straight to wrist at the base of the hand. There is an additional flex line along the middle knuckle of the fingers.

In comparing glove design versus hand design, current gloves are designed for the natural hand closure. The flex lines will create a wide wedge. The thumb lays across the fingers in the closed position which reduces the size of the well. The enclosed backs, however, hinder closure while material layering hinders flex. Design recommendations for traditional closures include the fact that the flex lines should create a narrow wedge. The thumb of the glove lays parallel to the ring hand pinkie finger which maximizes the size of the well. The enclosed backs hinder closure. The pocket includes the index finger.

With regard to material stiffeners, advanced glove designs require stiffness along the thumb and outer fingers to enhance closure as well as a stiff connection between the closing fingers and the glove.

Cushioning should be along the lower palm of the hand, in the palm of the hand, and provide for the index finger. With respect to fit features for glove retaining, considerations should include: (1) thumb and finger internal loops, (2) the fan shaped spreading of fingers, (3) the well shape which allows gravity to assist in glove retention, (4) tight finger slots with sufficient room for fingers, and (5) finger tension on glove.

With regard to hand position versus glove performance, two hand positions are considered. The traditional position and the position of fingers closer together with the thumb at 90 degrees. This latter position offers a larger pocket but less sensitivity.

In view of the foregoing, a preferred glove concept employs (1) air in a bladder in the back of the hand, (2) an air system that retains the fingers, (3) an active air system that encloses the ball after the catch, (4) quilted air bladders to create the proper flex points and (5) an active air system that enhances the closing of the glove.

There have been a wide variety of technical advances associated with baseball gloves and with inflatable devices. By way of example, boxing gloves with inflatable bladders are disclosed in U.S. Pat. Nos. 320,972 to Rumsy; 531,872 to Shibe; 570,092 to Harvey; 600,779 to Frazier; 1,622,322 to Kennedy; 2,275,206 to Sutherland; 2,653,319 to Slizus; and 3,217,333 to Sweet.

Pneumatic pads and guards for use in athletic contests include U.S. Pat. Nos. 4,067,063 to Ettinger and 4,370,754 to Donzis. Gloves and mittens for miscellaneous purposes include U.S. Pat. Nos. 972,224 to Pease; 1,053,204 to Morrison; 2,842,771 to Foti, and 4,486,975 to Harreld. Lastly, advancements in baseball gloves which include pneumatic devices include U.S. Pat. Nos. 450,717 to Reach; 1,465,223 to Kobbe; 1,602,027 to Kennedy, and 4,937,882 to Hayes.

Accordingly, it is an object of the present invention to provide an improved game glove including a front portion and a back portion defining a hand space therebetween and forming a major region for receiving the fingers of the wearer and a minor region for receiving the thumb of the wearer; an opening at one edge of the glove for the passage of the hand of a wearer into the hand space; a bladder positioned in the hand space, the bladder having a major portion in the major region of the glove and a minor portion in the minor region for the glove; and an inflation system to selectively inflate the bladder the inflation system including a pump system having a diaphragm for selectively inflating the bladder to improve the fit of the glove on a wearer's hand, the pump system also including a tube coupling the diaphragm and the bladder.

A further object of the invention is to implement light weight air bladders into baseball and softball gloves to provide an inner structure for custom fit and shock absorption.

A further object of the present invention is to provide pump buttons and releases and the like which are accessible for easy use.

A further object of the present invention is to provide a consistent flex pattern by the appropriate air system design while maintaining traditional design details and materials.

A further object of the present invention is to maintain or reduce the weight of all gloves by use of air technology to eliminate heavier padding.

A further object of the present invention is to improve break in characteristics of game gloves.

A further object of the present invention is to provide a true custom fit for baseball gloves by utilizing inflation technology.

A further object of the present invention is to allow baseball and softball players to change the fit of gloves by altering inflation pressures.

A further object of the present invention is to improve the design of pumps for use in selectively inflating bladders.

A further object of the present invention is to supplement a baseball glove with an inflation system comprising a low pressure bladder for hand retention and a high pressure bladder for finger rigidity.

A further object of the invention is to provide lacing holes in the periphery of inflatable bladders to insure proper positioning thereof.

A further object of the invention is to shape diaphragms of pumps for baseball gloves in an oval configuration.

It is a further object of the present invention to abate the blockage of air flow between pumps and bladders in inflatable game gloves.

It is a further object of the present invention to facilitate the flow of air in inflatable baseball gloves during inflation and deflation.

It is a further object of the present invention to design inflatable bladder/pump assemblies so as to make them suitable for either left- or right-handed gloves.

Lastly, it is an object of the present invention to improve the design features of game gloves for maximum comfort, flex and efficiency.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

For the purpose of summarizing this invention, this invention may be incorporated into an improved game glove including a front portion and a back portion defining a hand space therebetween and forming a major region for receiving the fingers of the wearer and a minor region for receiving the thumb of the wearer; an opening at one edge of the glove for the passage of the hand of a wearer into the hand space; a bladder positioned in the hand space, the bladder having a major portion in the major region of the glove and a minor portion in the minor region for the glove; and an inflation system to selectively inflate the bladder the inflation system including a pump system having a diaphragm for selectively inflating the bladder to improve the fit of the glove on a wearer's hand, the pump system also including a tube coupling the diaphragm and the bladder.

The pump system further includes a first and a second axially aligned valves operatively coupled with the diaphragm, the first valve adapted to allow for the flow of air to the bladder through the tube from the diaphragm upon the depression thereof, and the second valve adapted to allow for the flow of air from atmosphere to interior of the diaphragm upon the release thereof. One valve is a one-way, duck-bill check valve. One valve is a ball valve. The pump system includes a button for selectively deflating the bladder. The glove further includes a housing for supporting the pump system in the back of the glove with the diaphragm and button exposed for contact and use by the wearer of the glove. The glove further includes a ledge adjacent to the button to preclude inadvertent depression thereof.

The invention may also be incorporated into a game glove formed of front layer of material and back layer of material defining a hand space between the layers, the glove having an opening at an edge for the passage of the hand of a wearer into the hand space, the glove also having a major region for the fingers of the wearer and a laterally disposed minor region for the thumb of the wearer, a bladder adjacent to the back layer in the hand space behind the hand of the wearer, the bladder having a peripheral flange with apertures for the passage of lacing therethrough, and valve means to selectively inflate and deflate the bladder with elongated means coupling the valve means and bladder and with aperture means in the back material in the minor region to expose the operative portions of the valve means for operation and control by a wearer of the glove.

The bladder includes a major portion in the major region of the glove and a minor portion in the minor region of the glove with an intermediate portion therebetween. The game glove further includes quilting dots heat sealing front and back faces of the bladder in areas corresponding to joints of the wearer's hand. The intermediate portion is positionable in the central portion of the back of the wearer's hand.

Lastly, the invention may also be incorporated into an improved pump for inflating a bladder for use in an inflatable glove having a diaphragm to insure the secure coupling of the glove to the hand of a wearer, the pump comprising a diaphragm formed of a resilient material and capable of being depressed and released by the wearer, a first and second valve laterally spaced from the diaphragm with means to couple the diaphragm and the bladder, the first valve being adapted to allow for the flow of air to the bladder from the diaphragm upon the depression thereof, and the second valve being adapted to allow the flow of air from atmosphere to interior of the diaphragm upon the release thereof, and a release valve associated therewith which, when depressed, will relieve the air pressure from the bladder.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 2:
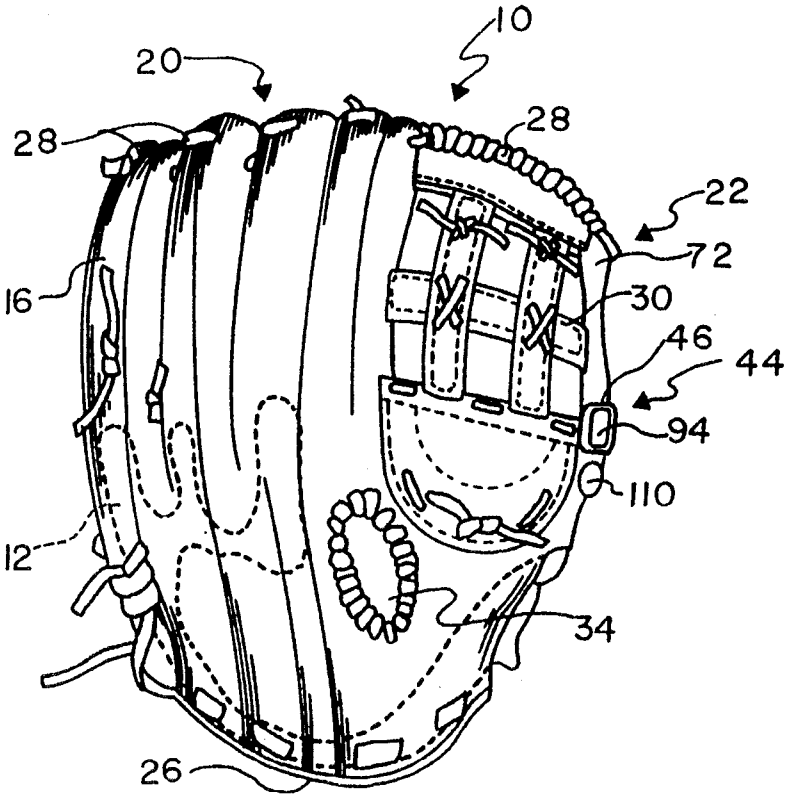
FIGS. 1 and 2 are front and rear elevational views of a baseball glove constructed in accordance with the primary embodiment of the invention.
Figure 1:
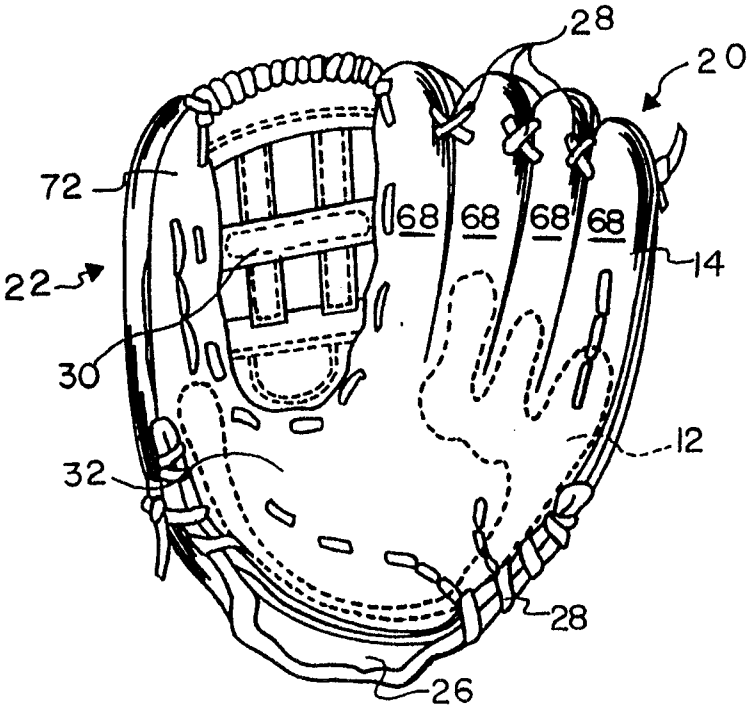

Shown in FIGS. 1 and 2 is a game glove 10, as for baseball, softball or the like, having an inflatable bladder 12 constructed in accordance with the principles of the present invention. The glove 10 is a generally conventional baseball glove in its design. It is fabricated of a plurality of pieces 14, 16, etc. of material, preferably leather, front and back. The material defines a major region 20 for the receipt of the wearer's fingers and a minor region 22 for the receipt of the wearer's thumb. An opening 26 is formed at the lower edge of the glove 10 between the front and back component pieces 14 and 16 through which the wearer may insert his hand into a hand space. Stitching and cords 28 couple the various pieces of the glove to render it a unitary device. Located between the thumb region and finger region of the glove are the webbing 30 at the upper extent and the well 32 at the lower extent which together form a pocket in which the ball is preferably caught. An aperture 34 is formed in the back piece 16 through which the wearer may extend his index finger.

The thumb region 22 and finger region 20 are pivotable about the well and webbing areas by the movement of the wearer's thumb toward the fingers or the fingers towards the thumb to entrap the ball when being caught.

The glove 10 is essentially conventional in most regards except for a bladder 12 with a layer of material 38 interior of the glove for forming a bladder-receiving pocket 40 and a pump system 44 to inflate the bladder 12 with an aperture 46 in the glove 10 for exposing portions of the pump system.

The glove 10 of the primary embodiment is shown in FIGS. 1 and 2 with the bladder 12 in dotted line configuration. Such bladder is more particularly seen in FIGS. 3 and 5. The bladder is formed of two pieces 50 and 52 of air impervious elastomer, preferably urethane. Other similar light weight, air impervious, inflatable materials could readily be utilized. The two pieces of bladder material are essentially of the same shape front and back and are heat sealed around their edges 54. In addition to the heat sealing around the edges, additional heat sealing is provided in the nature of dots 56. Such dots preclude the inflated bladder from becoming excessively thick. They also constitute built-in flex points at the knuckles or other joints of the wearer for the enhancement of glove bending and closure.

The bladder 12 is formed of two major portions, the finger or major portion 60 and the thumb or minor portion 62 with an elongated coupling portion 64 therebetween. The finger portion 60 has essentially linear parts 66 adapted to extend from near the central portion of the glove 10 upwardly into the fingers of the glove toward the tip ends of each finger of the glove. Such finger portions 66 of the bladder are adapted to be received in the lower extents of the fingers 68 of the glove. The thumb portion 70 of the bladder is also extended and adapted to be positioned within the lower extent of the thumb portion 72 of the glove 10.

The thumb and finger portions of the bladder are each provided with a plurality of quilting dots 56 of heat sealing along the lengths thereof. Such dots add rigidity and support for the fingers and thumb. Flexibility is also enhanced due to their locations at the joints of the fingers and thumb as well as at the finger and thumb regions of the glove. A plurality of such dots 56 are also located in the coupling portion to keep the bladder portions together to a limited extent. The coupling portion 64 of the bladder 12 is relatively thin simply to couple the thumb and finger portions 60 and 62 together for concurrent inflation and deflation. The dots also function to preclude excess ballooning of the bladder when in operation and use.

Figure 3:
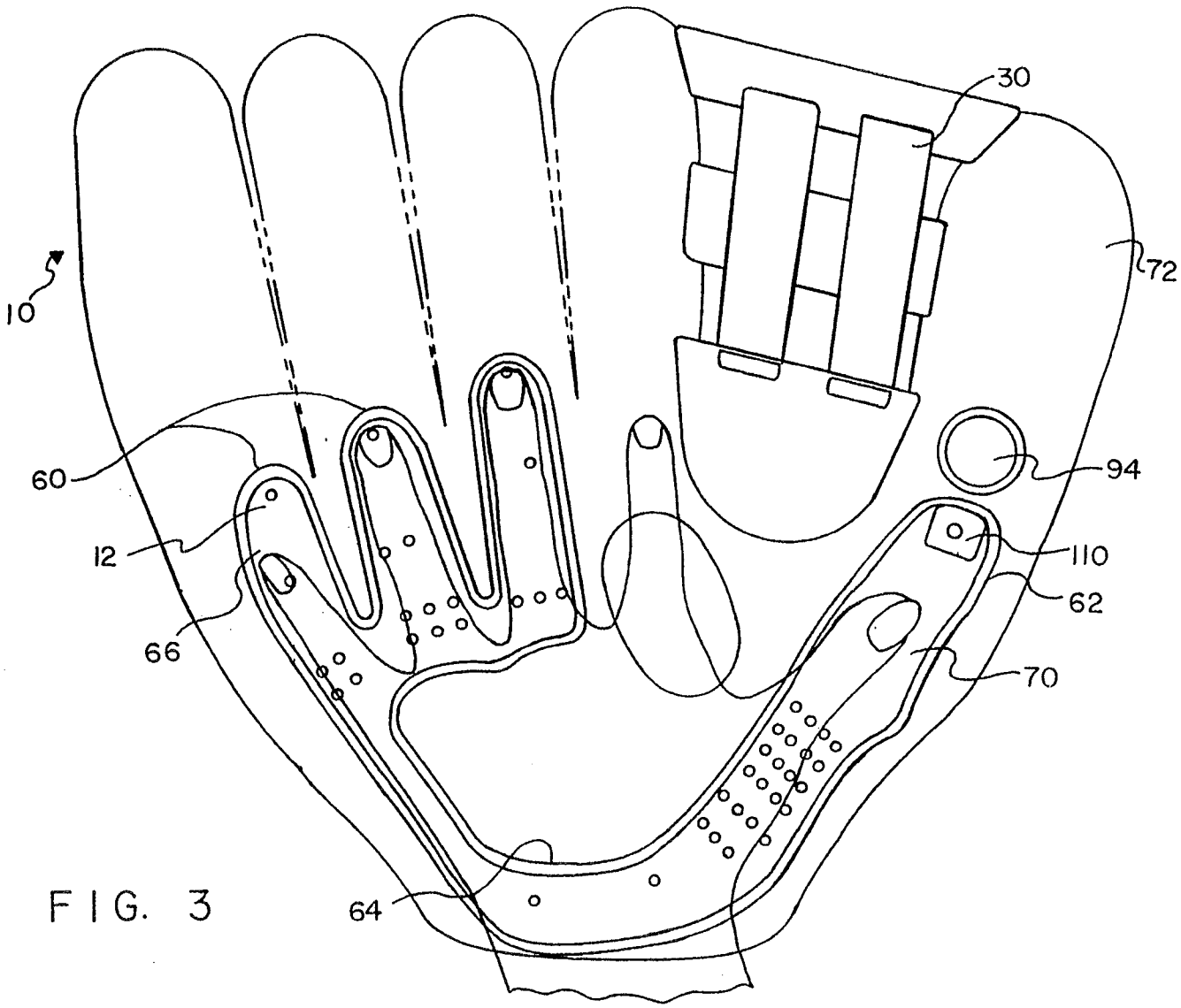
FIG. 3 is a front elevational view similar to FIG. 1 but illustrating the wearer's hand with a glove shown in phantom lines and resting flat.
Figure 4:
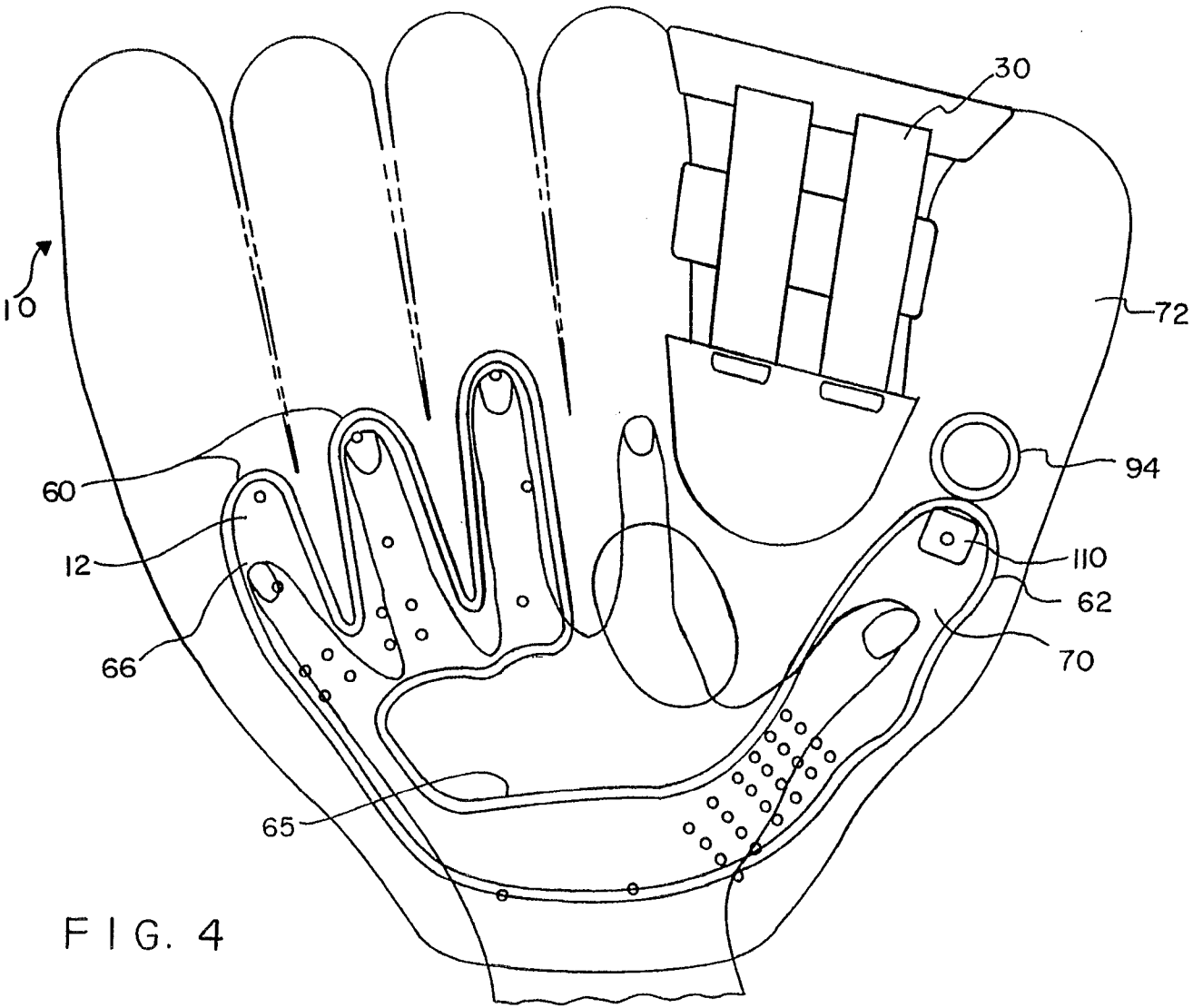
FIG. 4 is a view similar to FIG. 3 but showing an alternate embodiment of the invention.

FIG. 4 is an alternate embodiment similar to FIG. 3. In the FIG. 3 embodiment, the coupling portion 64 is located at the lowermost edge of the back of the glove. In the FIG. 4 embodiment, the coupling portion 65 is raised slightly, midway between the lower edge of the glove and the lower edge of the finger opening 34 to give support to the back of the wearer's hand.

Figure 5:
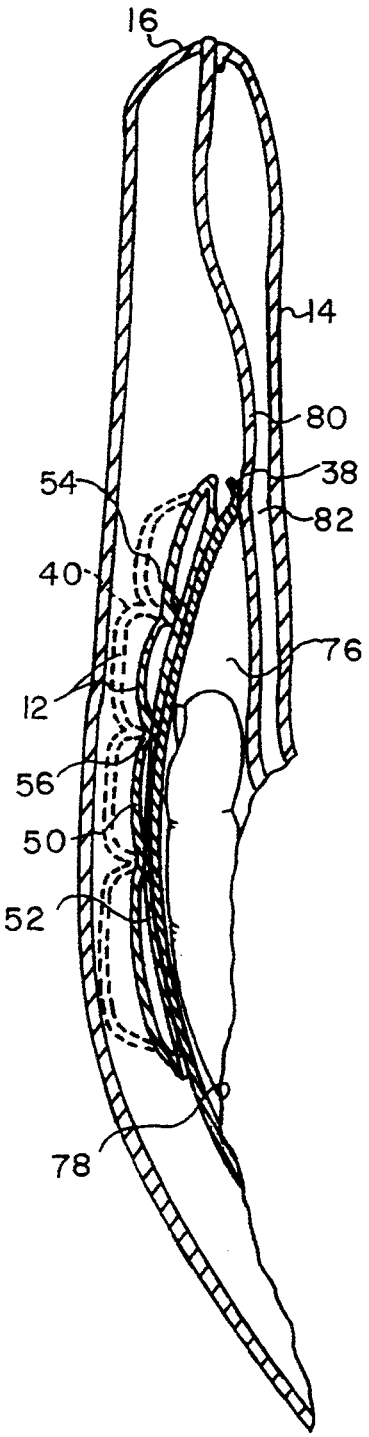
FIG. 5 is a sectional view of the glove of FIGS. 1 through 3 and taken through the middle finger.

FIG. 5 is a cross sectional view of a portion of the bladder shown positioned within a glove, the glove being positioned on a wearer's hand. The deflated bladder is shown in solid lines while the inflated bladder is shown in dashed lines. Shown in the central extent of the glove is the finger space 76, a portion of the hand space 78 for the wearer's hand. The leather shown in the glove of FIGS. 1 and 2 are also seen at the front and back of the FIG. 5 sectional view. Also shown in FIG. 5 is an intermediate layer 80 as of material such as leather or the like to separate the finger from additional padding 82 between such intermediate layer and the front piece. Also located behind the finger space is a layer of flexible material 38, as for example lamb skin or the like, which can breathe appropriately. The flexible material with the rear piece 16 of the glove forms a pocket 40 in which the bladder 12 is located. The lower edge of the fabric encloses such pocket with the aid of a coupler such as adhesive or stitching to maintain the pocket closed. A releasable coupler could also be readily utilized. In addition, the lower edge of the bladder may be stitched to the glove. The bladder 12 may be inflated to an appropriate extent through the use of the pump system 44. Similarly, the air may be selectively removed from the bladder. In this manner, the glove may be made to conform more securely to the wearer's hand so that upon catching the ball, jarring of the glove with respect to the hand is abated for increasing comfort, security and efficiency in catching balls.

Inflation and deflation of the bladder is effected through a pump system 44 which is most readily seen in FIGS. 6 through 10. The pump system 44 includes a pump or diaphragm 86, preferably blow molded, with associated check valves 88, 90 and a release valve 92, all interrelated with each other and with the bladder 12 to effect the desired result of selectively inflating and deflating the bladder for insuring proper fit of the particular glove to the particular wearer.

The diaphragm 86 is a one piece element formed of a resilient elastomeric material such as rubber, natural or synthetic or blend thereof. It is adapted to be depressed on its exposed exterior surface 94 by a user to decrease the volume of air within the diaphragm chamber. Upon release of the diaphragm, the volume of air within the chamber increases as the diaphragm returns to normal expand configuration as shown.

Figure 6:
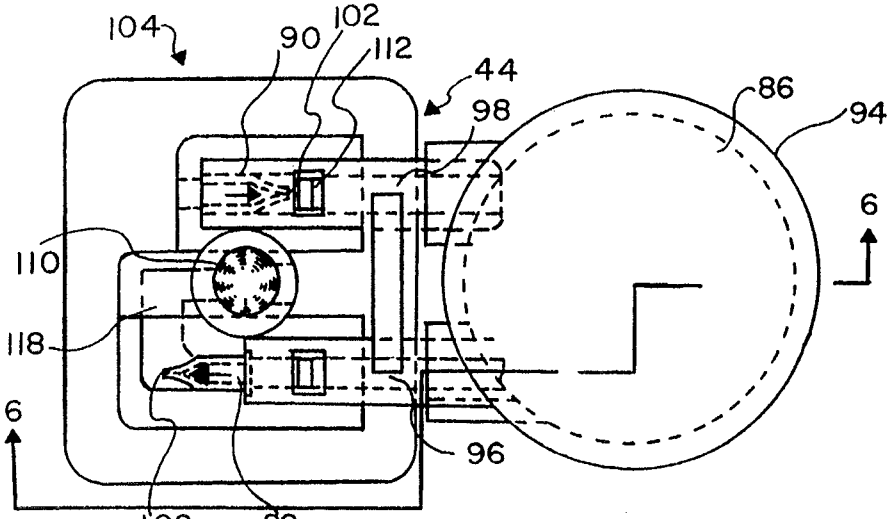
FIG. 6 is an elevational view of the pump system shown in the prior figures.
Figure 7:
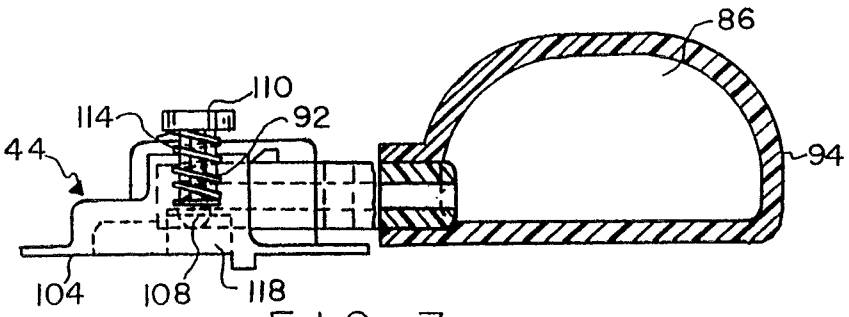
FIG. 7 is a partial sectional view taken along line 7—7 of FIG. 5.
Figure 8:
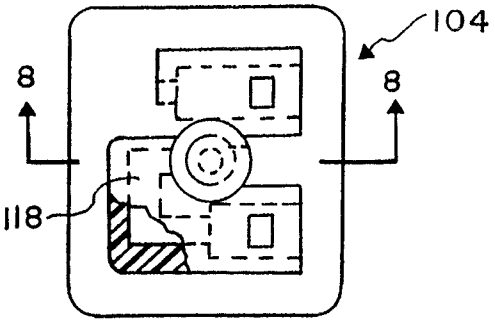
FIG. 8 is a left side elevational view of the pump system of FIG. 7.
Figure 9:
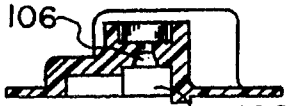
FIG. 9 is an elevational view of the fitting shown in FIGS. 6 through 8.

Along one edge of the diaphragm are a pair of essentially rigid tubes 96, 98, one for conveying air from the interior of the diaphragm into the bladder and one for conveying air from the atmosphere to interior of the diaphragm. The interior surface of each of the tubes receive the exterior surfaces of one of the pair of check valves 88 and 90, preferably of the conventional duck-bill type. The upper check valve 90 as shown in FIG. 6 is oriented to allow for the suction of air from the atmosphere to the chamber interior of the diaphragm 86 upon release of the diaphragm which, upon resiling of the diaphragm, increases the diaphragm chamber volume and generates a suction. A similarly configured but oppositely directed check valve 88 is in operative association with the second tube 96 for the moving of air from interior of the diaphragm to the bladder upon depressing of the diaphragm which decreases the volume within the diaphragm chamber to increase the pressure therein.

The valves 88 and 90 themselves are formed of elastomeric material, preferably silicone, with an aperture near the tip and a tube 102 of flexible, elastomeric material in a flat, ribbon-like configuration. Such arrangement constitutes a conventional duck-bill valve. Under normal conditions, each valve is such as to preclude the flow of air therethrough. When, however, a pressure differential is generated on opposite sides thereof through the depression or release of the diaphragm, the tube 102 of the check valves will open for the flow of air in one direction as shown by the arrows. Upon the cessation of pumping, the tube 102 of each check valve will close to preclude further movement of air therethrough.

The check valves 88 and 90 are supported in a housing 104. The housing also supports an adapter 112 which couples the diaphragm tubes with the one-way valves. The housing and the adapter are constructed of a rigid material preferably a plastic such as polyurethane. It includes an upper aperture 106 in which is located a release ball 108. The release valve 92 has an upper surface or button 110 adapted to be depressed by the user to force a stopper downwardly. The release ball 108 is spherically shaped and seated in the aperture 106 which is correspondingly shaped. Downward movement of the button 110 and release ball 108 thus creates an opening between the stopper and the walls of the housing aperture for the release of the pressurized air within the bladder. A coil spring 114 is located between the button 110 and the housing 104 to urge the stopper 108 upwardly upon the release of pressure generated by the finger of the operator to thereby retain the air within the bladder. Beneath the release ball 108 is a continuation of the air passage 118 for pneumatically coupling the bladder and the diaphragm.

The housing 104 is coupled with the bladder 14 as through an adhesive or welding and extends through an aperture 46 in the glove 10 to expose the diaphragm 86 and button 110. In this manner, the diaphragm is exposed so that it may be used by the wearer while the button of the release valve is similarly exposed, also for use by the wearer.

Figure 10:
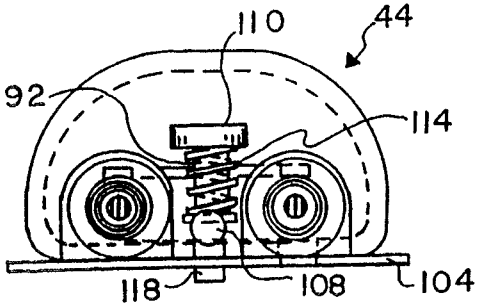
FIG. 10 is a sectional view of the fitting taken through line 10—10 of FIG. 9.
Figure 11:
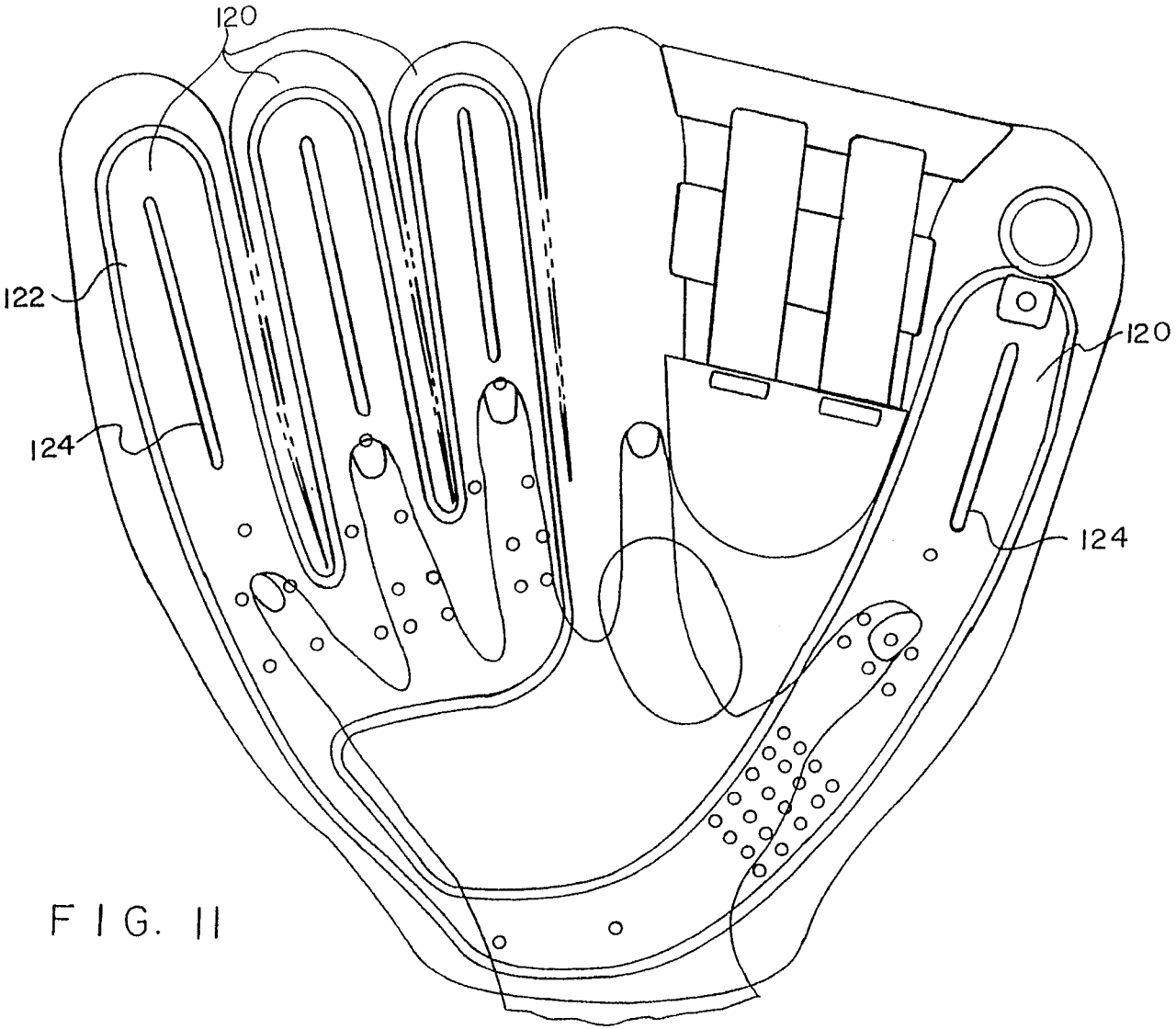
FIGS. 11 and 12 are front elevational views of gloves with bladders constructed in accordance with alternate embodiments of the invention.
Figure 12:
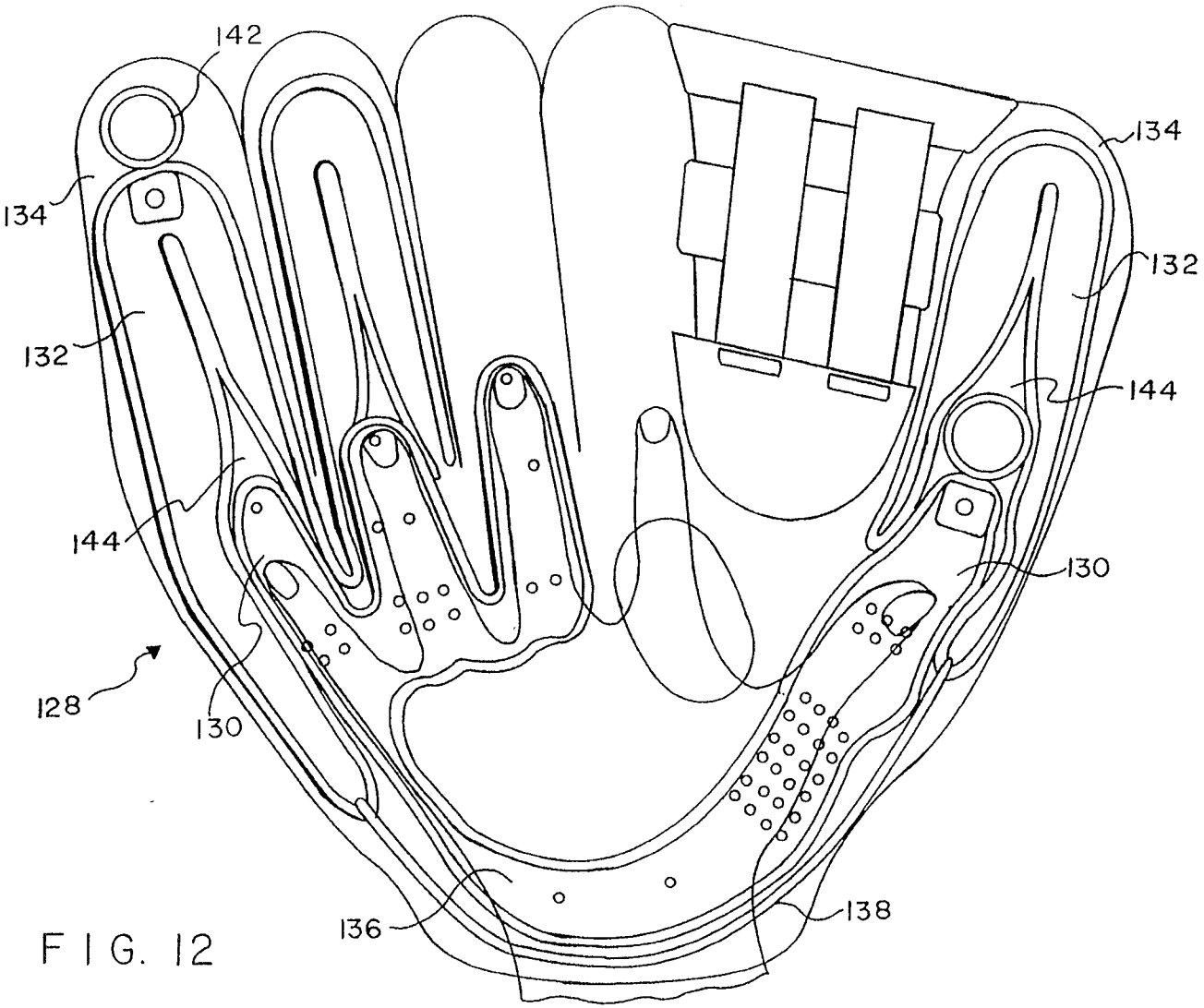
Figure 14:
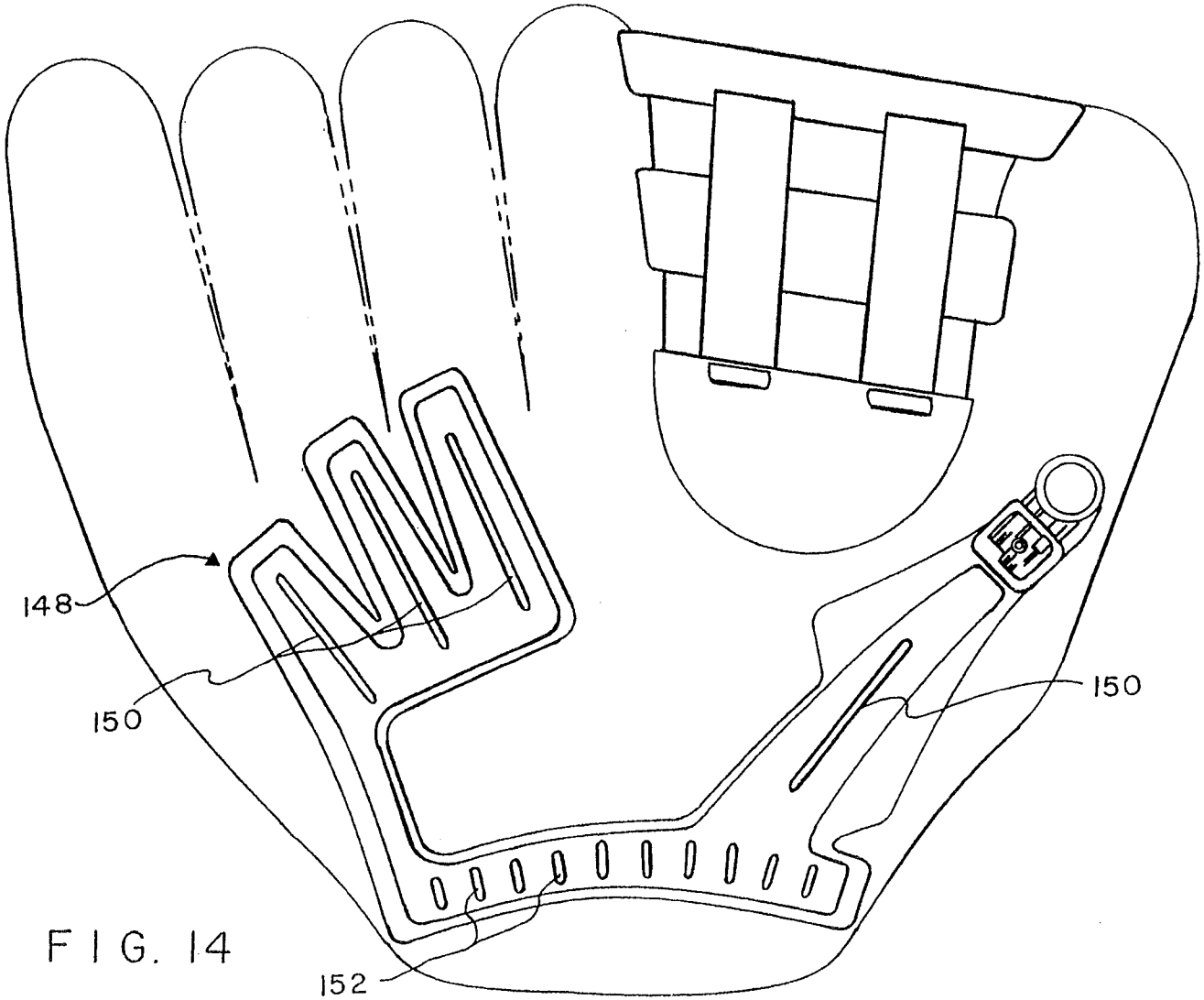
FIGS. 14, 15 and 16 are front elevational views of bladders constructed in accordance with three additional alternate embodiments of the invention.
Figure 15:
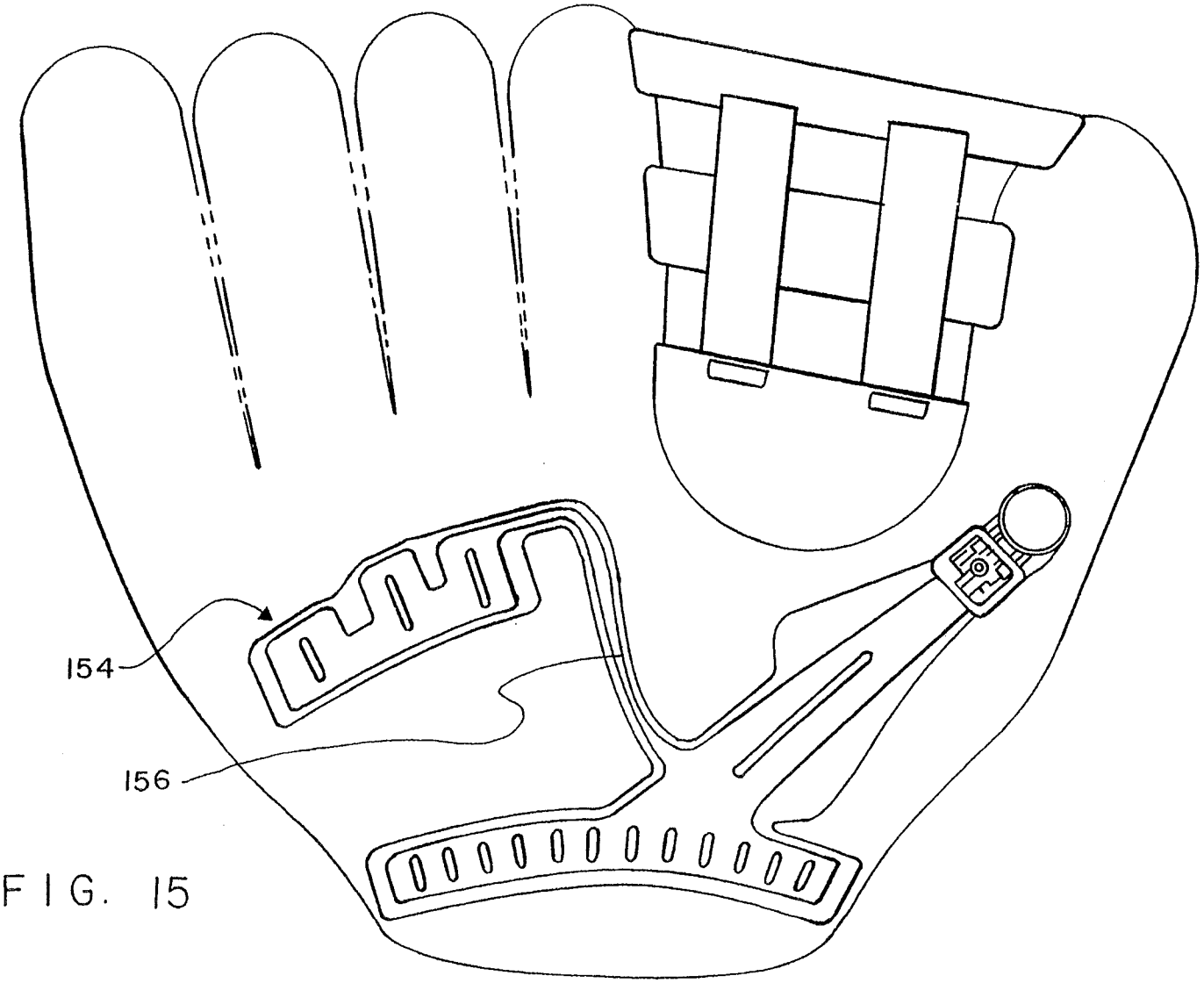
Figure 16:
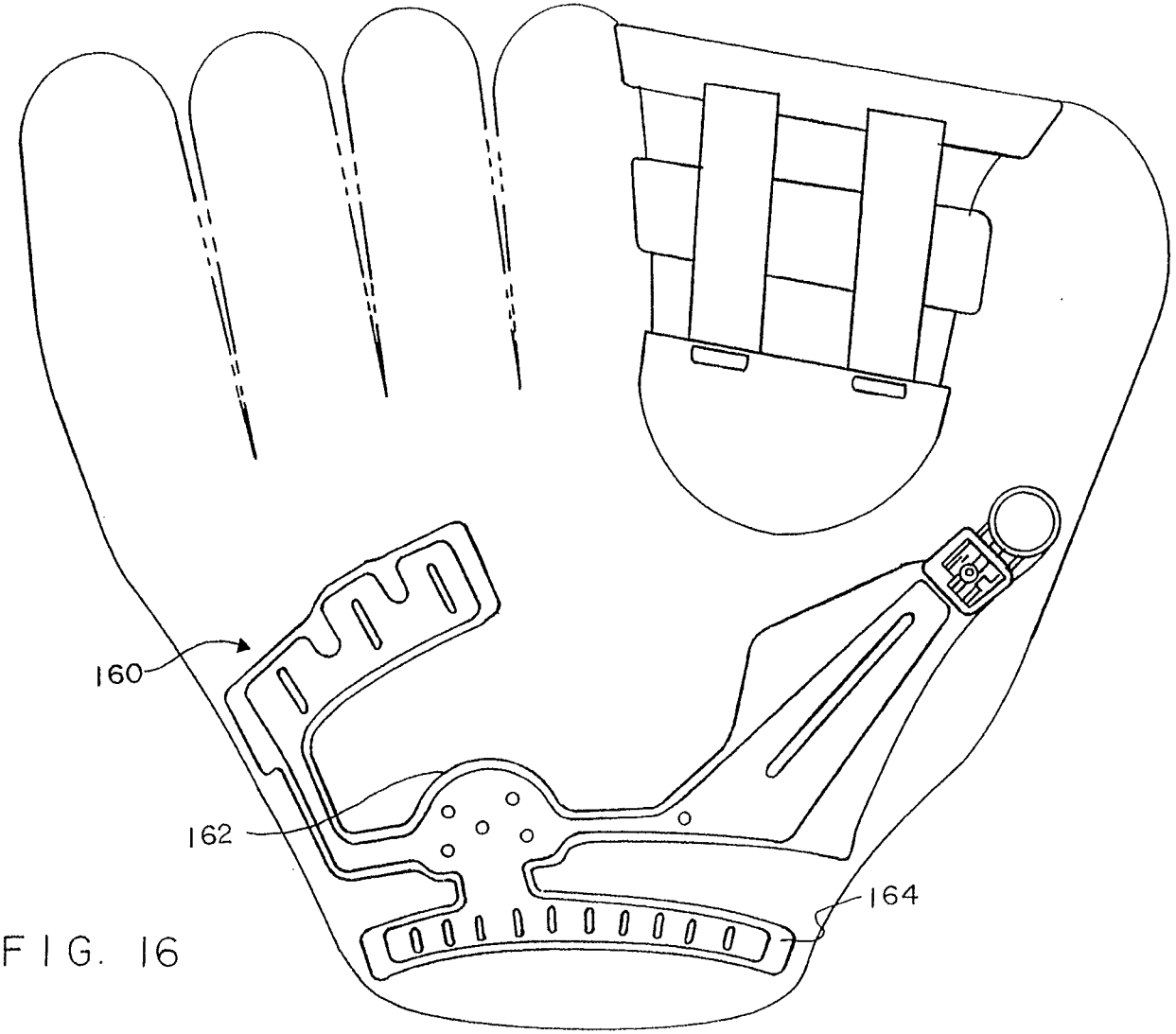
Figure 17:
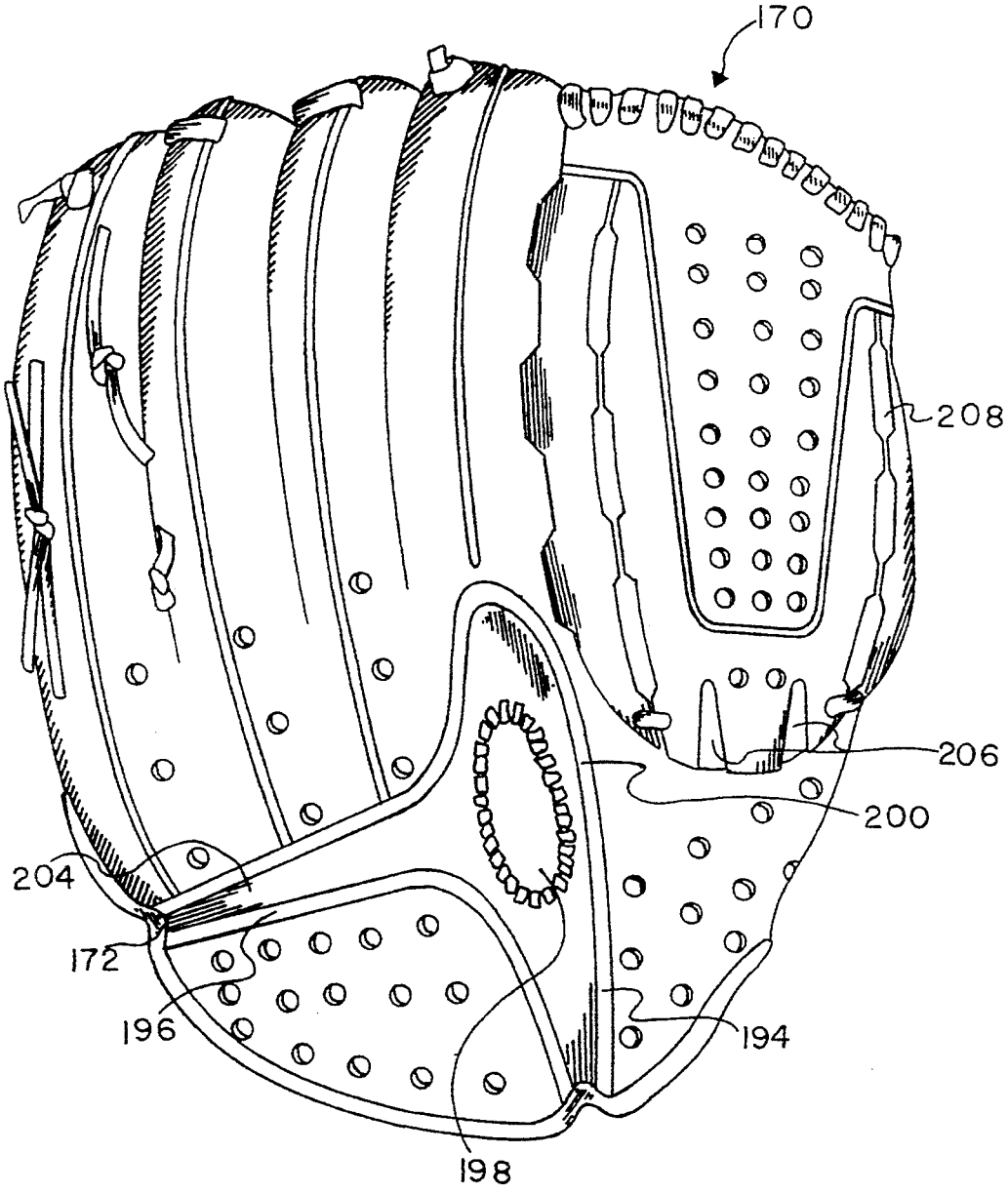
FIGS. 17 through 20 are front, back and side elevational views of a glove constructed in accordance with an additional embodiment of the invention.
Figure 18:
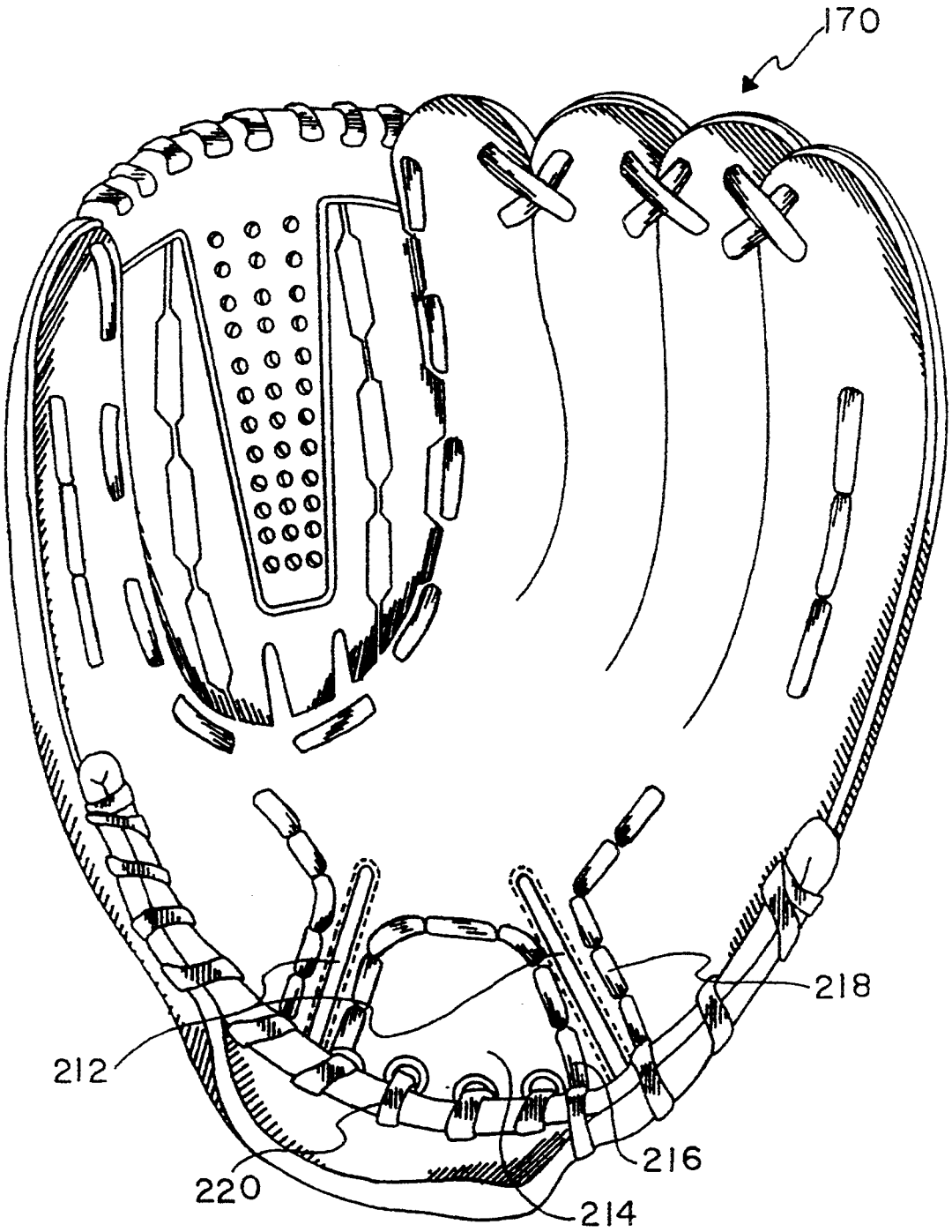
Figure 19:
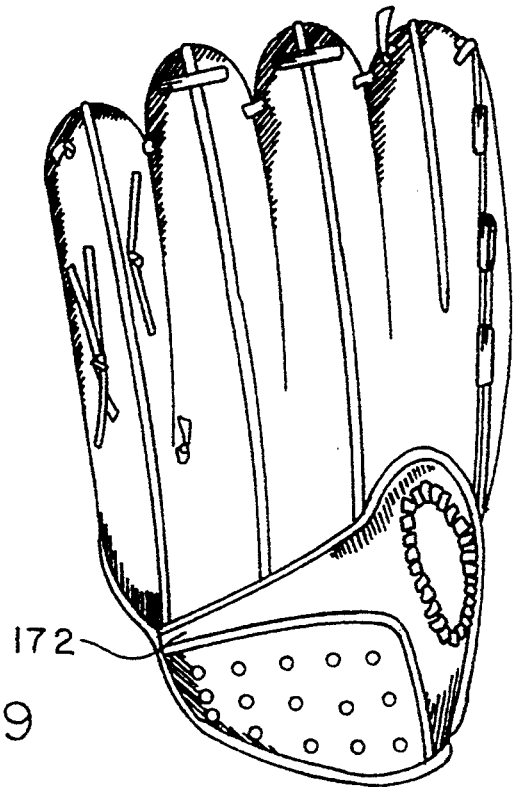
Figure 20:
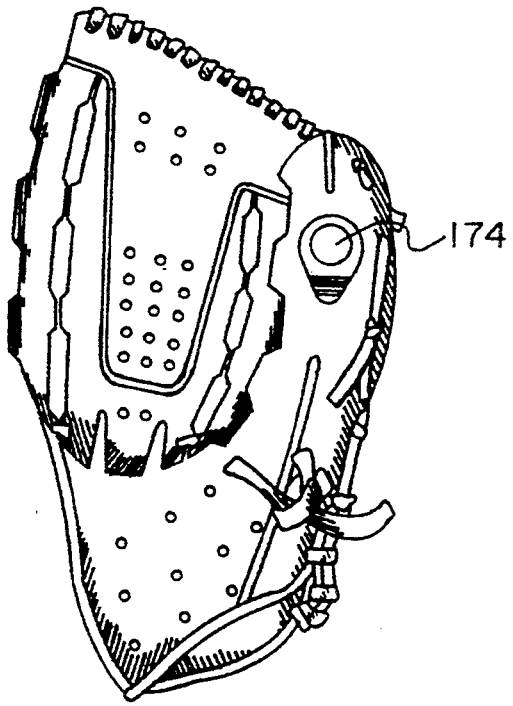

Alternate embodiments of the bladders are shown in FIGS. 11 and 12. Further alternate embodiments are shown in FIGS. 14, 15 and 16. The first alternate embodiment as shown in FIG. 10 is a bladder 122 similar to the primary embodiment of FIGS. 1 through 3 except for the fact that the fingers 118 are more elongated than in the first embodiment, extending the full length of the fingers of the glove. In addition, heat sealing quilting includes lines 124 are provided in the bladder fingers and thumb for adding rigidity and strength to the glove in the region beyond the wearer's fingers and thumb.

Shown in FIG. 12 is another alternate embodiment of the invention. In this embodiment, the inflatable bladder 128 is actually a bladder system formed of a first or low pressure bladder 130 of a construction the same as or similar to that of the embodiment shown in FIGS. 1 through 3. And, in addition, a second or high pressure bladder 132 is located in other regions of the glove. The high pressure bladder 132 extends outwardly from the thumb and finger portions of the low pressure bladder 130 to fill the spaces of the glove previously unoccupied by thumb or fingers of the low pressure bladder. The purpose of the high pressure bladder is to add rigidity to the thumb and fingers of the gloves all the way to a location adjacent their tips 134, regions which are normally unsupported except for the strength and rigidity of the leather or other material of which the glove is fabricated. In this manner, the glove can be made of less expensive material or thinner constructions of conventional leathers for cost saving purposes.

It has been found that such high pressure of the second bladder 132 should not be placed between the hand and glove in the location of the primary bladder since the excess pressure would cause discomfort to the wearer and possibly cut off circulation after extended use. Further, in the FIG. 12 embodiment, no fingers are provided in the high pressure bladder adjacent to the middle and index finger of the wearer since the rigidity is mostly needed at the extremities of the glove beyond the thumb as well as the ring and little finger of the wearer. Flexibility is thus desirably extended to the central portion of the glove at the middle finger and index finger. In this manner, the entire glove and bladder are constructed to add maximum flexibility for the wearer when catching a ball. Note is taken that the primary bladder has no finger component in the index finger area about which the thumb and other fingers pivot when catching a ball. Similarly, there is no bladder in the back of the hand immediately beneath the knuckles since such might abate flexibility at such location. This is accommodated by having the central bladder portion 136 of both the primary and secondary bladders behind the hand immediately above the wrist rather than across the back of the hand adjacent to the knuckles. In order to accommodate this bladder construction, the back of the glove extends downwardly a greater distance to cover the entire wrist of the wearer to provide a covered passageway for the central portion of the bladder coupling the thumb with the fingers.

The central connecting portion of the low pressure bladder is simply an extension of the sheets of air impervious material which constitute such bladder. In the second bladder, a hollow tube 138 connects the two portions of the high pressure bladder effecting a common pressure throughout the secondary bladders. Further, a second pump 142 is located on the back of the glove near the tip end of the little finger for inflating and deflating the high pressure bladder in a manner the same as for the first bladder but pneumatically independent thereof. The high pressure bladder is intended to be inflated to about 4 to 5 pounds per square inch while the low pressure bladder is intended to be inflated to about 2 to 3 pounds per square inch.

Lastly, the configuration of the second bladder is such that each finger area is provided with a central opening 144 at its base in which is located the corresponding thumb and finger parts of the primary bladder. In this manner, the two extreme fingers and thumb of the wearer are contacted by the primary bladder but surrounded by the secondary bladder for adding the desired rigidity to the glove without providing excess pressure to the wearer's hand. A sectional view of this embodiment, taken through the ring finger, is shown in FIG. 13.

FIGS. 14, 15 and 16 illustrate modified alternate designs for the primary bladder. In the FIG. 13 embodiment, the thumb and finger portions of the bladder 148 are substantially the same as those in the embodiment of FIGS. 1 through 3, extending a length substantially equal to the wearer's fingers and thumb. The weld dots of such prior embodiment, however, are replaced by weld lines 150 axially along the lengths of the thumb and finger portions. Similarly, weld lines 152 are provided in the back and retention area across the back of the wrist to preclude excessive enlargement of the primary bladder at such location.

Figure 13:
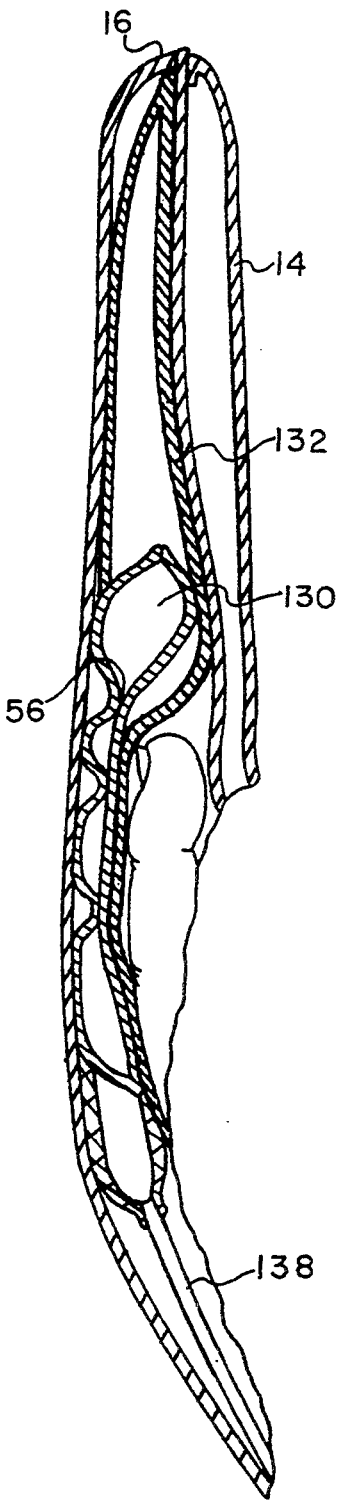
FIG. 13 is a sectional view of the glove taken through the middle finger of the FIG. 12 embodiment.

The FIG. 15 embodiment is a bladder 154 similar to FIG. 13 except that the fingers are of a shorter construction providing support only at the central portions of the fingers of the wearer. Specifically, the bladder is located to extend from above the knuckles, across the middle joints of the fingers and halfway to the outermost joints of the fingers. In addition, a modified air channel 156 provides for a more direct coupling between the wrist, thumb and finger regions of the bladder.

The last embodiment, that shown in FIG. 16, is a bladder 160 similar to FIG. 14 except that the central area 162 of the bladder, that coupling the thumb and fingers is enlarged to provide a back hand fill area to provide additional support to the central portion of the back of the wearer's hand above the wrist and beneath the knuckles or other bend points of the hand. The lowermost cross-piece 164 is thereby located beneath the lowermost edge of a conventional glove, immediately above the wearer's wrist. In order to accommodate such new cross-piece 164, the back of the glove is extended downwardly, an increased amount as compared to conventional gloves, nearly to the wearer's wrist, for effecting the desired securement between the wearer's hand and glove. In the earlier embodiment, the back of the glove is also extended downwardly, an increased amount as compared to conventional gloves, in order to accommodate the bladder or bladders.

Shown in FIGS. 17 through 20 are front and rear perspective illustrations of a further embodiment of a game glove 170 as for baseball, softball or the like, having an inflatable bladder 172 and constructed in accordance with another embodiment of the present invention. The glove is provided with improved flexibility in various regions to render it more efficient for use with the bladder. Except for the flex points and the bladder, the glove is conventional in most regards. It does, as in prior embodiments, have a layer of material interior of the glove for forming a bladder-receiving pocket. It also has an inflation/deflation or pump system 174 to inflate and deflate the bladder with an aperture in the glove for exposing portions of the pump system for inflation and deflation purposes.

Figure 21:
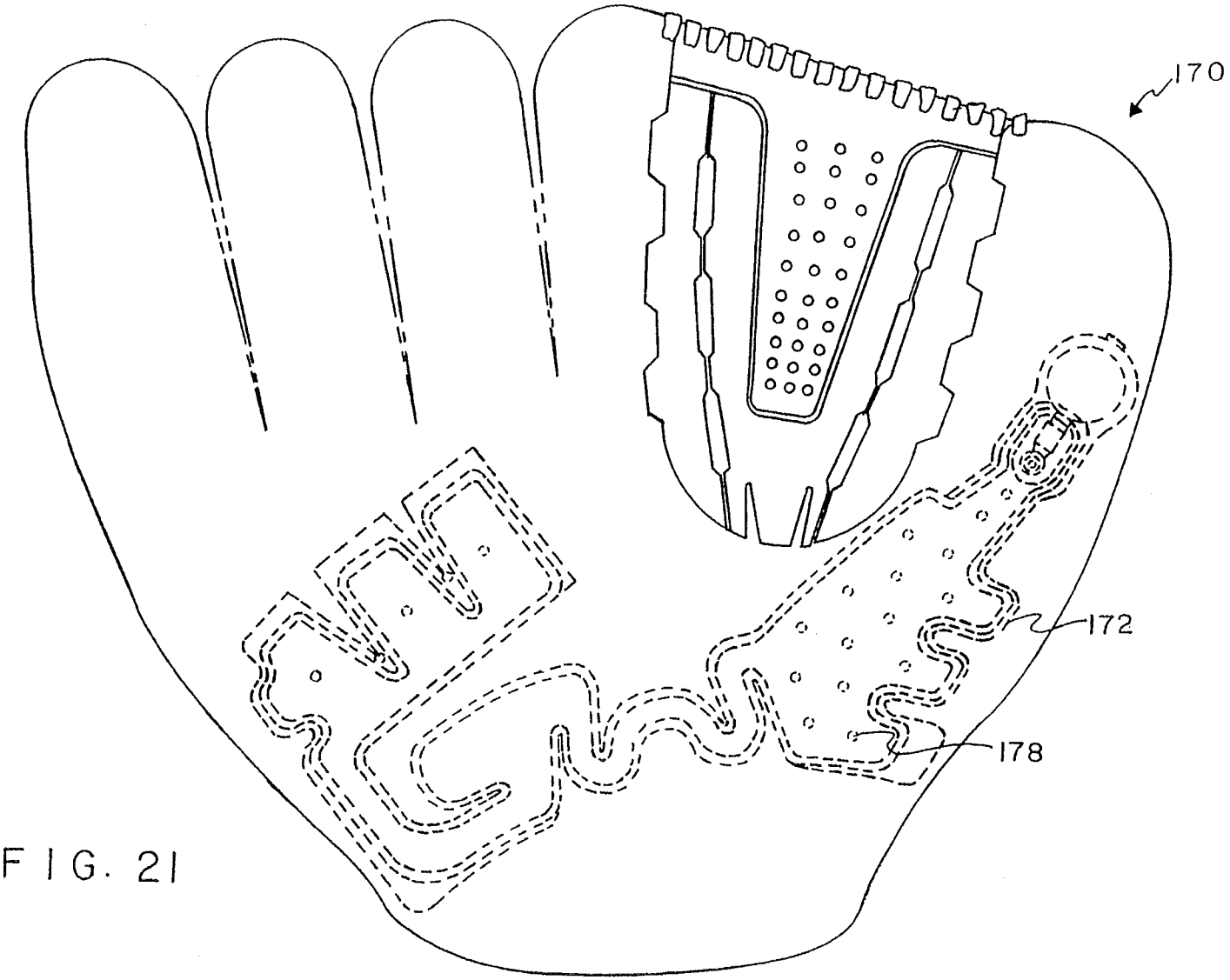
FIG. 21 is a front elevational view of the glove shown in FIGS. 17 through 20 and illustrating the bladder in phantom lines.

FIG. 21 shows the glove 170 with the bladder 172 in dotted line configuration. The bladder itself is more particularly seen in FIG. 22. The bladder is formed of two pieces and of an air impervious elastomer, preferably urethane. Other similar light weight, air impervious, inflatable materials could readily be utilized. The two pieces of bladder material are essentially of the same shape front and back and are RF welded or otherwise coupled and sealed around their edges. In addition to the coupling around the edges, additional welding or heat sealing or quilting is provided in the nature of dots 178. Such quilting precludes the inflated bladder from becoming excessively thick and pillowing.

The bladder is formed of two major portions, the finger or major portion 180 and the thumb or minor portion 182 with an elongated coupling portion 184 therebetween. The finger portion has essentially linear parts 186 adapted to extend from near the central portion of the glove upwardly towards the fingers of the glove. Such finger portions correspond to the little finger, ring finger and middle finger. The finger portions are adapted to overlie the back of the wearer's hand above the knuckle upwardly to below the end most joint. The thumb portion 182 of the bladder is also extended and adapted to be located adjacent to the lower extent of the thumb portion of the glove.

The thumb and finger portions of the bladder are each provided with quilting dots 178 of heat sealing along the lengths thereof. Such dots add flexibility and support for the fingers and thumb while preventing pillowing. A plurality of such quilting dots are located in the thumb portion. A single quilting dot is located in each finger portion over the joint adjacent to the knuckle. The coupling portion of the bladder is relatively thin and functions to couple the thumb and finger portions together for concurrent inflation and deflation. Flexibility is also enhanced due to the locations of the finger and thumb regions of the bladder and glove in relationship to the joints of the fingers and thumb.

In the region between the portion of the bladder adjacent to the thumb and that portion adjacent to the finger, the bladder has two unique features or parts. The first part 188 is the cross over area wherein the bladder connecting piece is bowed upwardly in an arc in the direction toward the fingers and away from the glove opening. This construction is to allow flexing of the glove about a vertical axis. Further, on the side of the bladder closer to the finger area, the bladder includes an enlarged part 190 beneath the back opening of the glove. This is to provide support to the back of the hand immediately beneath the knuckles, again for maximizing the secure coupling between the hand and glove without inhibiting movement of the wearer's hand joints.

The areas of the glove different from conventional gloves and those of the prior embodiments include a major cut out 194 in the lower back portion of the glove above the hand opening. This area includes a generally horizontal, lateral extent 196 tapering from the finger hole toward the base of the little finger. This extent also angles downwardly and covers the wearer's knuckles for added flexibility. Such opening also has a vertical extent 200 which extends upwardly and downwardly from the finger hole 198 for improved flex about a vertical axis between the thumb and fingers of the wearer's hand.

These areas of opening in the glove are covered by a flexible material 204 as for example a neoprene sheet or knit nylon fabric, for providing limited extensibility upon the application of pressure as occurred through the inflation of the bladder. The material is stitched to the interior of the glove around its periphery. Due to its location and properties, the material will provide a backing surface whereby bladder inflation will apply coupling forces between the glove due to the urging of the pocket material into pressure contact with the back of the wearer's hand with only limited stretching of the glove and its fabric. This effects maximum securement between glove and hand while still allowing for the flexibility required during use.

Further flexibility is provided by forming cutouts 206 in the lower back of the glove, at the terminal ends of the webbing to supplement the flexibility provided by the fabric.

Also located on the back side of the glove are openings 208, vertically extended on opposite sides of the webbing. These are shown as two sets of openings, each three in number, with the openings filled by fabric similar to that on the lower back side of the glove. In this manner, increased flexibility is allowed in the area adjacent the webbing functioning as a three piece web.

Flexibility is added to the front of the glove through the addition of generally vertical cut outs 212 with material covering the openings similar to the openings on the back side of the glove. The vertical front openings are located on opposite sides of a central lower padding well or 214. Such central lower padding is a region with peripheral stitching 216 to contain a cushion-like padding material, as for example, felt in the conventional manner. On opposite sides of the vertical front openings 212 are laces 218 which, with similar laces 220 around the periphery of the lower front padding, enhance the flex point of the glove at the bottom of the well. The padding on the edges and bottom of the glove thus function as three distinct pieces coupled to each other at flex lines.

Figure 24:
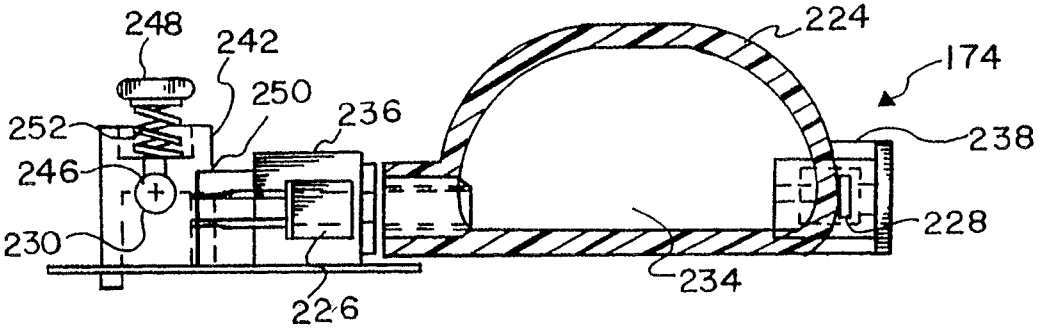
Figure 26:
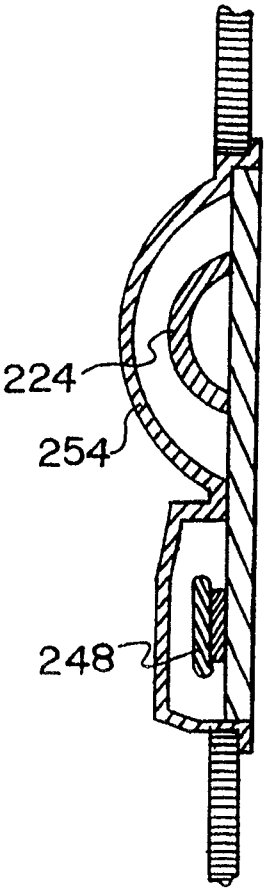
FIGS. 25 and 26 are a plan and sectional view of a cover for the pump system of FIGS. 23 and 24.
Figure 25:
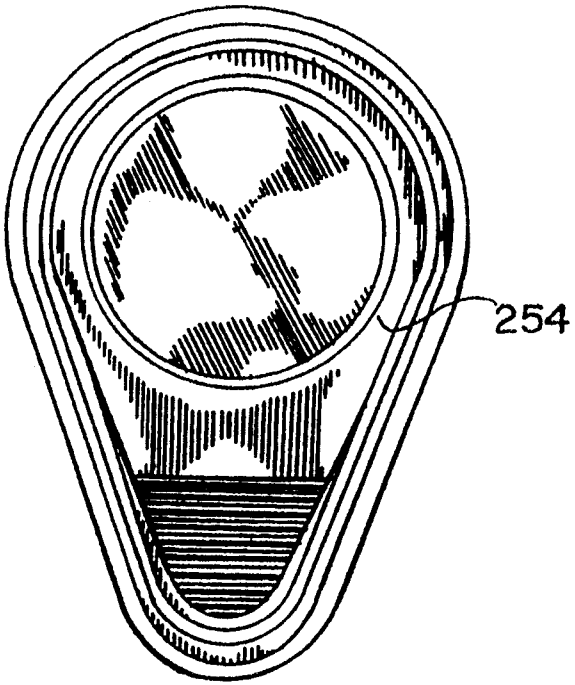
Figure 27:
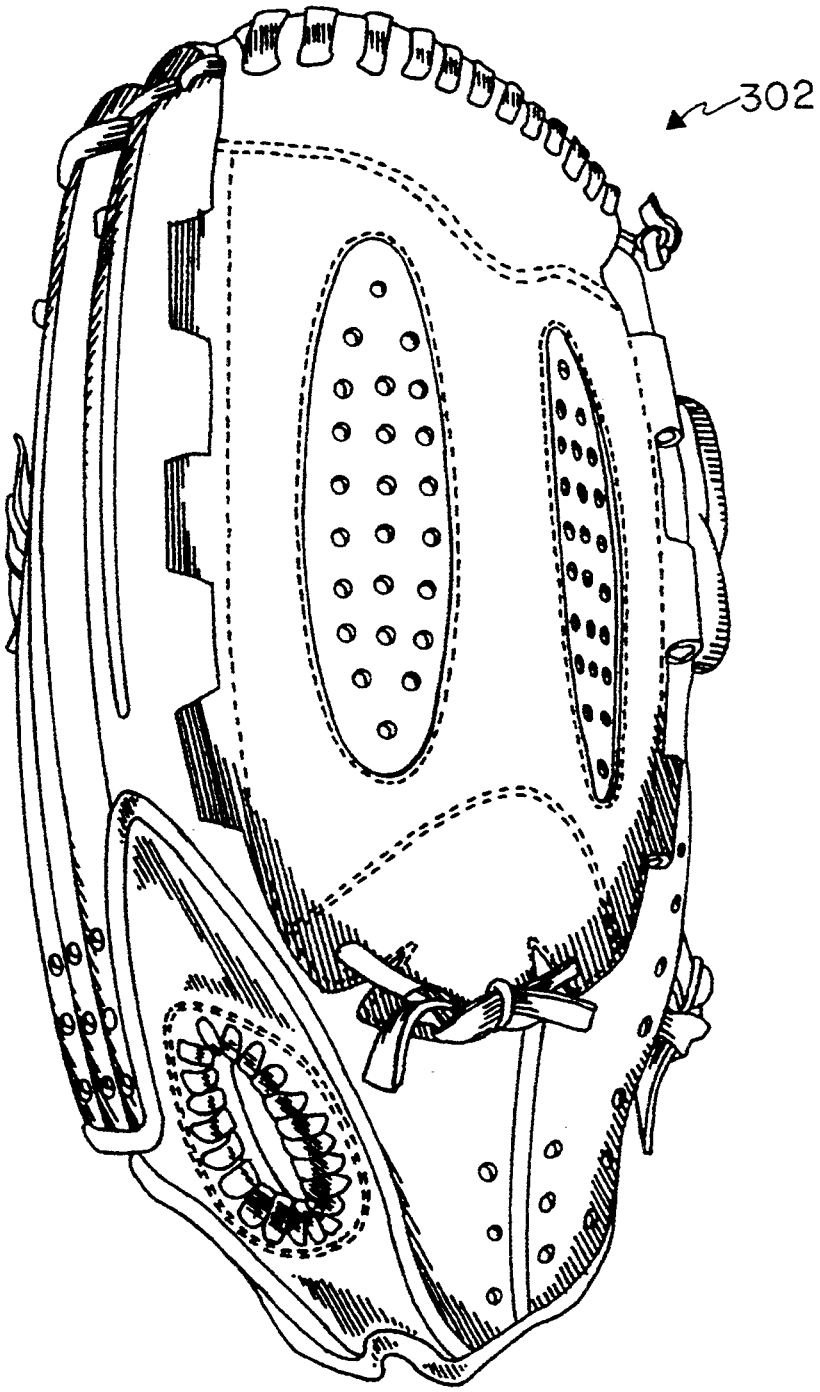
FIGS. 27–30 are perspective illustrations of a further embodiment of a inflatable baseball glove constructed in accordance with the principles of the present invention.
Figure 28:
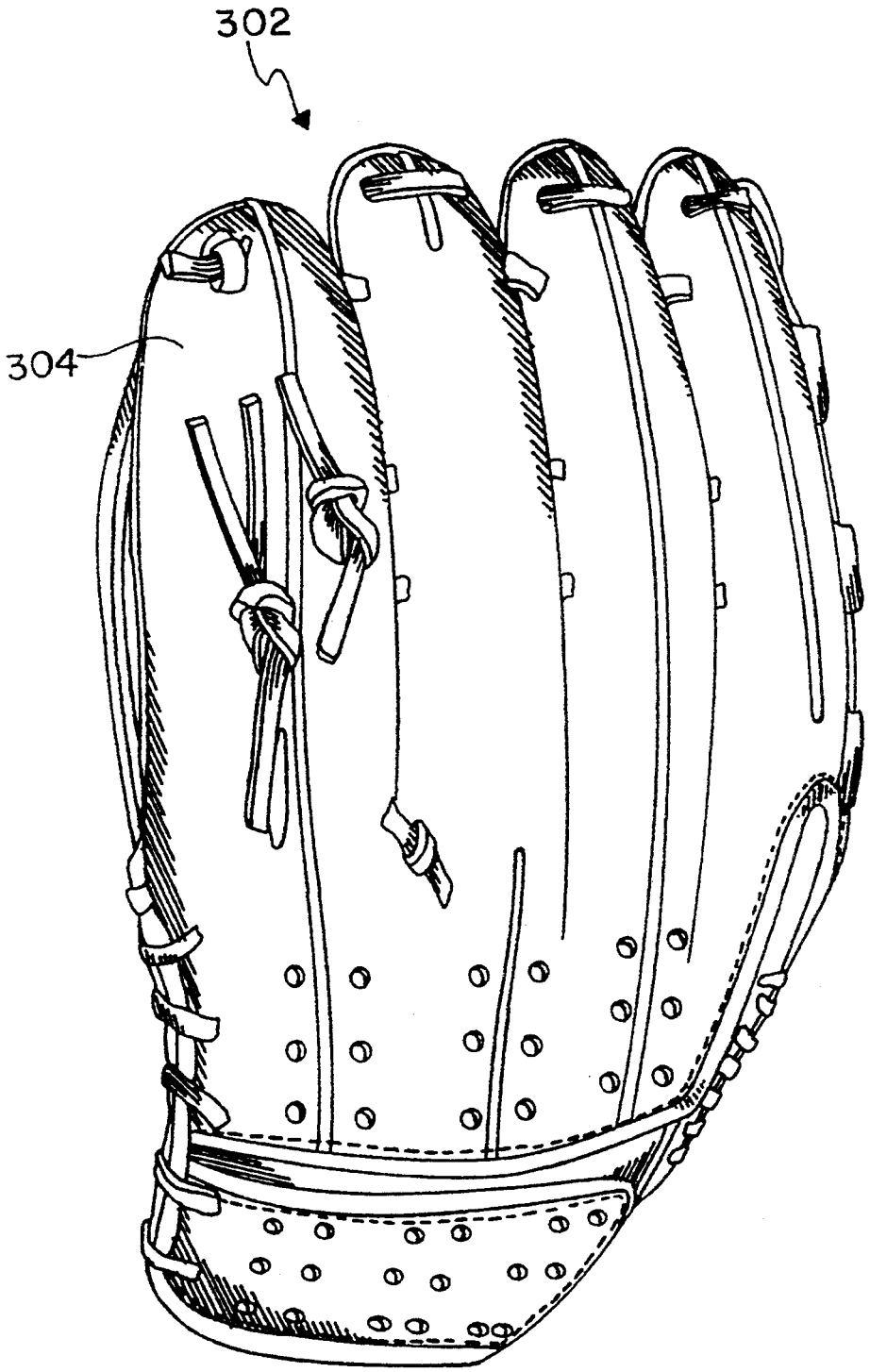
Figure 29:
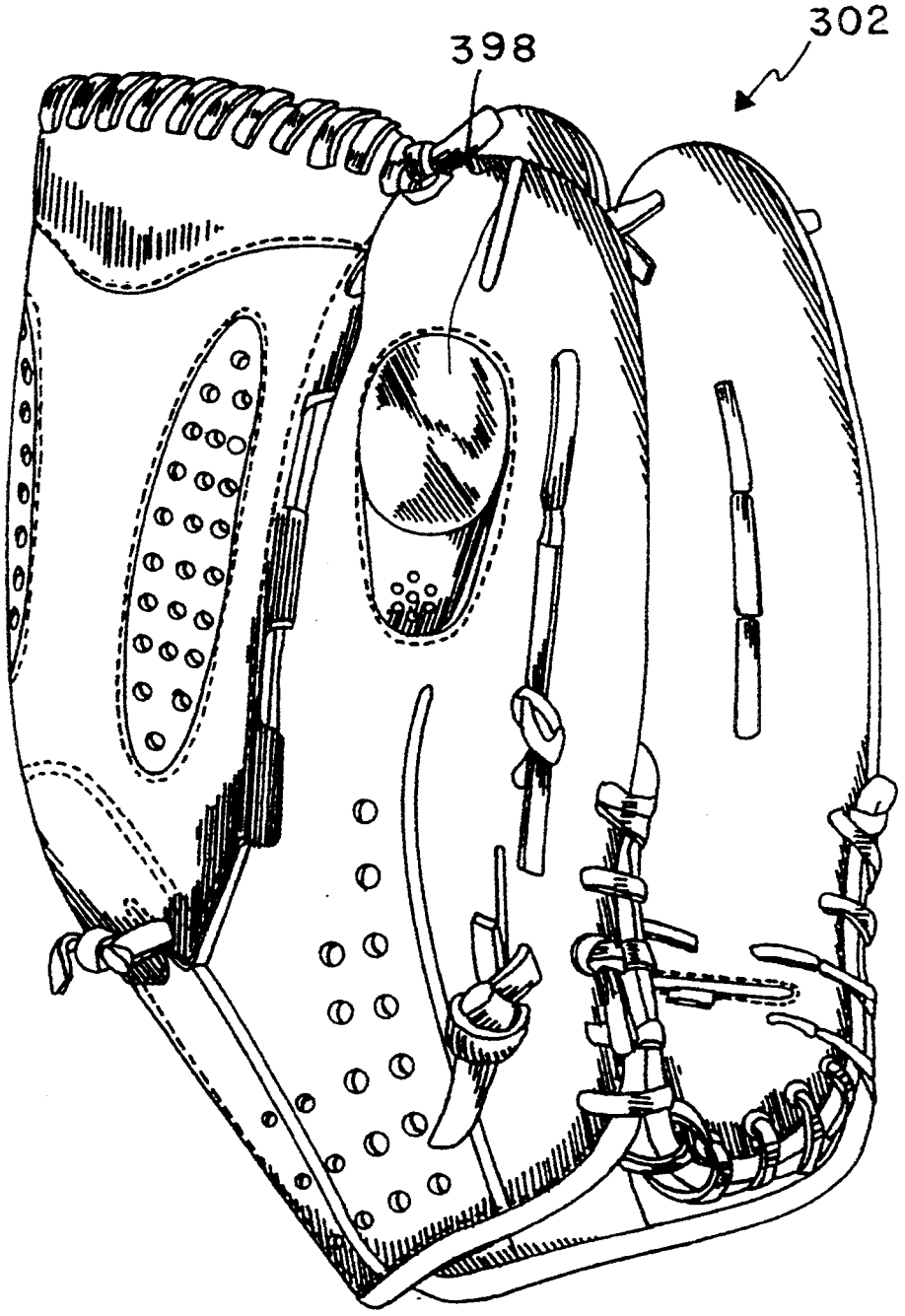
Figure 30:
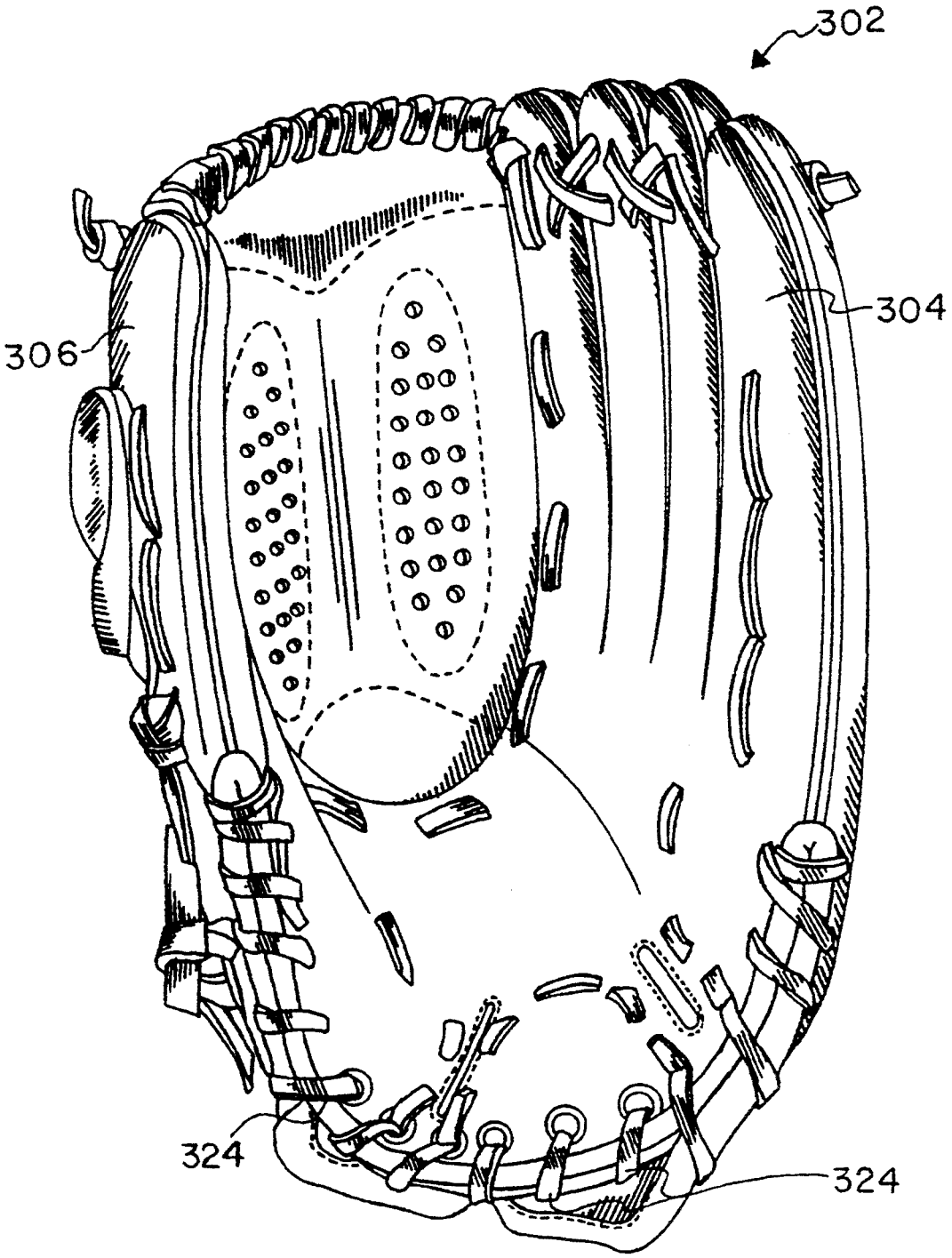

Inflation and deflation of the bladder 172 is effected through a pump system 174 which is most readily seen in FIGS. 24 and 25. The pump system includes a pump or diaphragm 224 preferably rubber dip molded or blow or injection molded, with associated one way valves 226 and 228 and a release valve 230 all interrelated with each other and with the bladder to effect the desired result of selectively inflating and deflating the bladder for insuring proper fit of the particular glove to the particular wearer.

The diaphragm 224 is a one piece element formed of a resilient elastomeric material such as rubber, natural or synthetic or blend thereof. It is adapted to be depressed on its exposed exterior surface by a user to decrease the volume of air within the diaphragm chamber 234. Upon release of the diaphragm, the volume of air within the chamber increases as the diaphragm returns to normal expand configuration as shown.

Axially aligned on opposite sides of the diaphragm are a pair of essentially rigid members, member 236 for conveying air from the interior of the diaphragm into the bladder and member 238 for conveying air from the atmosphere to interior of the diaphragm. The interior surface of each of the members receive the exterior surfaces of one of the pair of check valves 226 and 228 which are preferably of a conventional type. One check valve 228 is a disc diaphragm valve, a commercially available valve, which is oriented to allow for the suction of air from the atmosphere to the chamber interior of the diaphragm upon release of the diaphragm. Upon resiling of the diaphragm to its shown position, it increases the diaphragm chamber volume and generates a suction. A duck bill, one way valve 226 is an oppositely directed check valve. It is operative in association for the moving of air from interior of the diaphragm to the bladder upon depressing of the diaphragm which decreases the volume within the diaphragm chamber to increase the pressure therein.

Under normal conditions, each valve is such as to preclude the flow of air therethrough. When, however, a pressure differential is generated on opposite sides thereof through the depression or release of the diaphragm, the tube 102 of the check valves will open for the flow of air in one direction as shown by the arrows. Upon the cessation of pumping, the tube 102 of each check valve will close to preclude further movement of air therethrough.

The check valves are supported in a housing 242. The housing also supports an adapter 224 which couples the diaphragm tube with its the one-way valve. The housing and the adapter are constructed of a rigid material, preferably a plastic such as polyurethane. It includes an upper aperture in which is located a release ball 246. The release valve has an upper surface or button 248 adapted to be depressed by the user to force a stopper downwardly. The release ball is spherically shaped and seated in the aperture 250 which is correspondingly shaped. Downward movement of the button against its spring 252 lowers the release ball to thus create an opening between the stopper and the walls of the housing aperture for the release of the pressurized air within the bladder. The coil spring is located between the button and the housing to urge the stopper upwardly upon the release of pressure generated by the finger of the operator to thereby retain the air within the bladder. Beneath the release ball is a continuation of the air passage for pneumatically coupling the bladder and the diaphragm.

The housing is coupled with the bladder as through an adhesive or welding and extends through an aperture in the glove to expose the diaphragm and button. In this manner, the diaphragm is exposed so that it may be used by the wearer while the button of the release valve is similarly exposed, also for use by the wearer.

To extend the life of the pump system, the diaphragm 224 and button 248 are provided with a cover 254 of a flexible, resilient, elastomeric material. The diaphragm and button extend outwardly from the glove through a hole. The cover 254 is sized and shaped to cover such diaphragm and button and is provided with a peripheral lip interior of the hole for stitching the cover to the glove hole periphery. As such, the diaphragm can be contracted and expanded to inflate the bladder by depressing on the upper half of the cover. Similarly, the bladder pressure may be relieved by pressing on the lower half of the cover adjacent to the button.

The glove 302 of the final embodiment is similar to that shown in the prior figures in many regards. It has a major region 304 for the fingers of a wearer and a minor region 306 for the wearer's thumb. The inflatable bladder 310 behind the wearer's hand includes a major portion 312 adjacent to the finger region or portion 304 of the glove and a minor portion 314 adjacent to the thumb region or portion 306 of the glove with a coupling portion 316 therebetween. The bladder 310 is formed of facing sheets of urethane or similar flexible, air impermeable material. The bladder includes an extended periphery 320 adjacent to the edge of the glove with holes 322 which are adapted to receive the lacing strings 324 of the glove. This helps in retaining the bladder in position during use and allows proper placement of the bladder within the glove prior to stitching to the glove lining.

Further, with regard to the glove, the webbing 328 is of a one piece construction with two elongated oval portions 330 extending generally vertically. Each oval portion 330 is formed of superimposed material layers with apertures extending therethrough and with flexible mesh material 332 located between the layers. The ovals are on opposite sides of the vertical centerline of the webbing.

Figure 33:
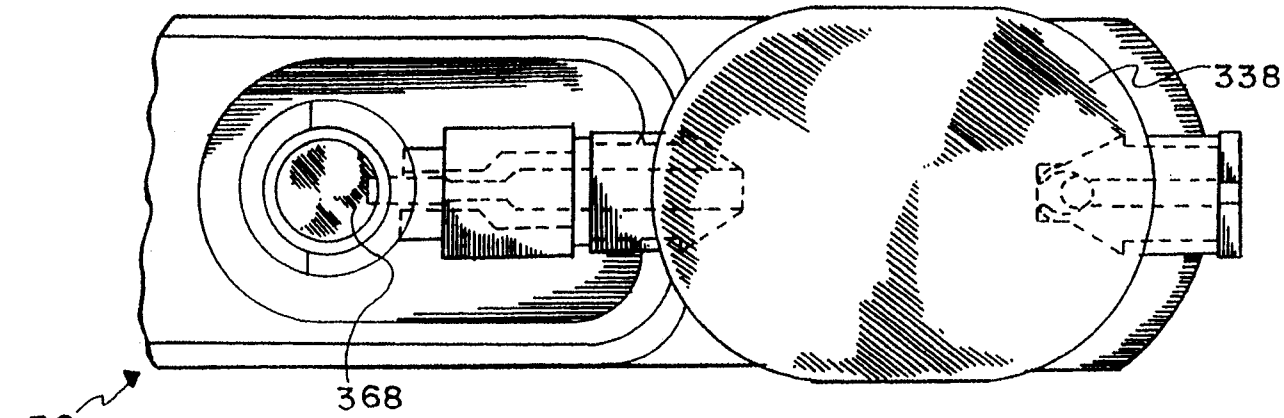
FIGS. 33 and 34 are a plan and sectional views of the air system assembly shown in FIGS. 31 and 32.
Figure 34:
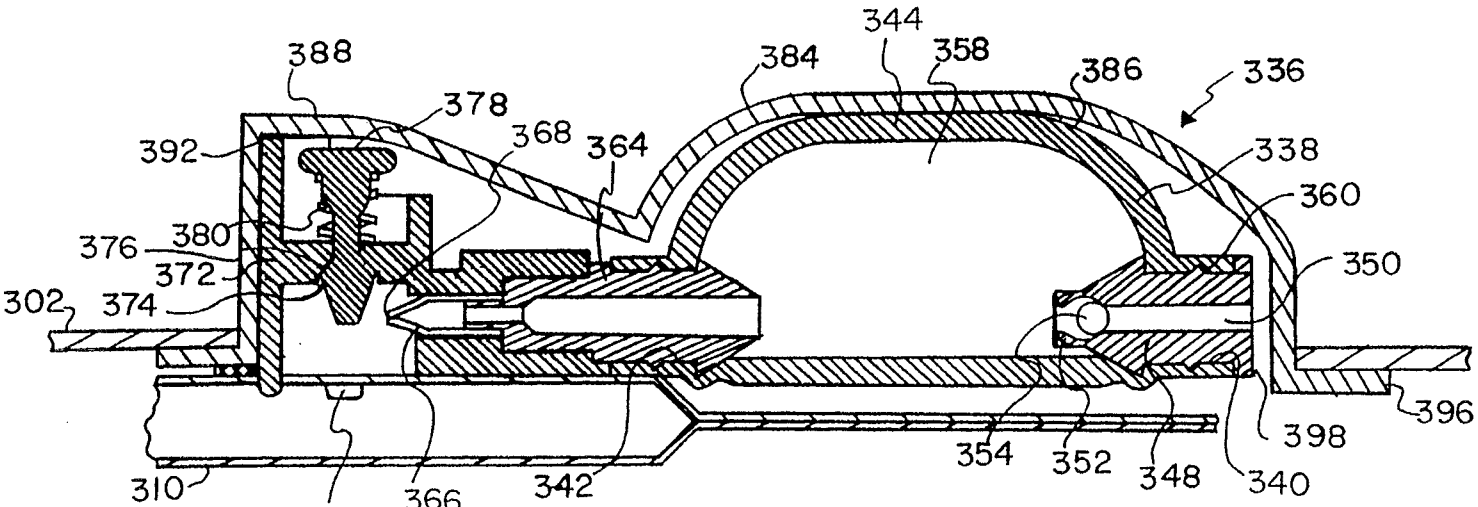
Figure 37:
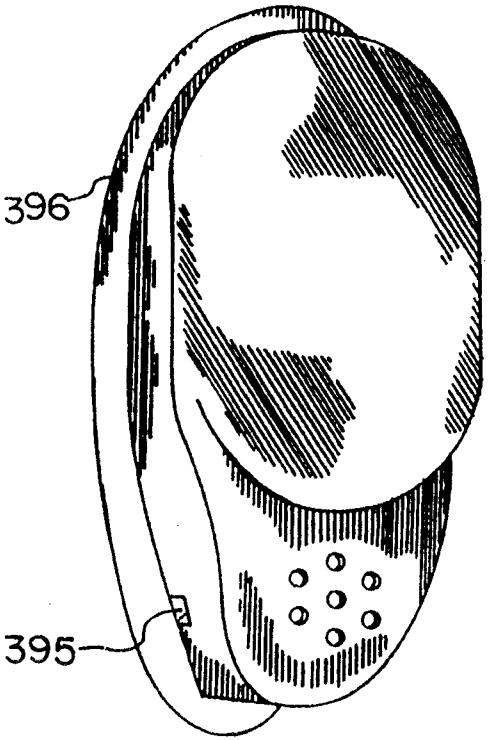
FIGS. 35, 36 and 37 are a perspective, plan and a side view of the cover for the air system assembly of FIGS. 33 and 34.
Figure 36:
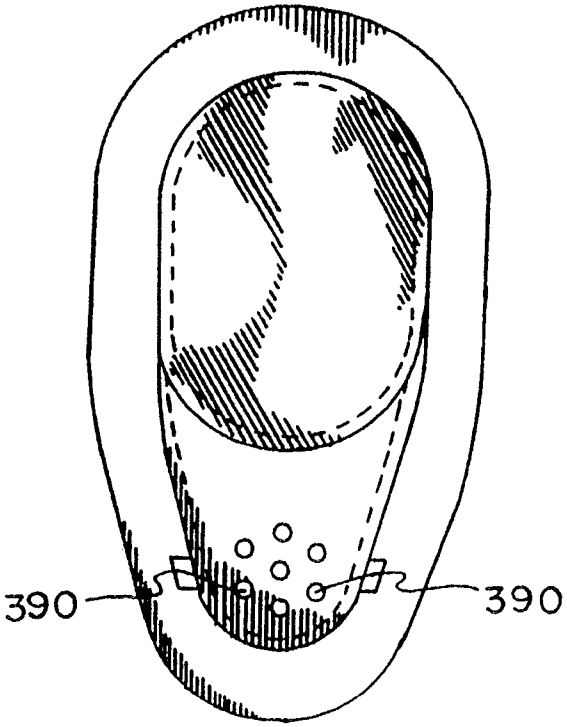
Figure 35:
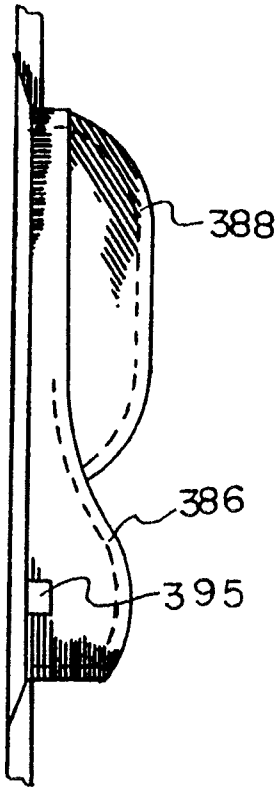

With regard to the air system 336 of assembly FIGS. 33 and 34, such system includes an elastomeric diaphragm or pump bulb 338. Such diaphragm 338 is preferably formed of latex, dip molded, and has a cylindrical input opening 340 and a cylindrical output opening 342 in axial alignment. The upper portion 344 of the bulb is generally oval in construction and adapted to be depressed and released by the user to pump air into the bladder 310. It is operatively coupled to the bladder adjacent to the output opening. It is operatively coupled to ambient air adjacent to the input opening.

At the input opening 340, an inlet check valve 348 is included. The inlet check valve includes a cylindrical aperture 350 extending therethrough with an enlargement 352 at the neck for the receipt of an essentially rigid ball 354. The ball is positionable in the valve through flexible lips at the inner end of the inlet check valve 348. The ball is movable forwardly with the release of the diaphragm to allow air to enter the chamber 358 of the bulb. The ball is movable rearwardly to preclude air from escaping from the chamber to atmosphere when the diaphragm is depressed. A barb or ridge 360 is circumferencially located and adapted to be received in an annular recess in the adjacent pump bulb opening for retaining the valve 348 in location.

An adaptor valve 364 is located at the output opening 342 of the pump bulb. Such valve 364 is adapted to communicate at its inboard end with the chamber 358 of the bulb and its outboard end with the bladder 310. A ridge 360 is received in an annular recess of the diaphragm similar to that in the inlet valve 348. A duckbill valve 366 with a circular cross section throughout the majority of its extent is received at the output end of the adapter valve 364. Its output end is tapered to a flat line 368 to allow the flow of air outwardly from the chamber toward the bladder for its filling in typical duckbill fashion.

The check valve 348 and the adaptor valve 364 are preferably fabricated of aluminum, screw machined parts, a material harder than the material of the diaphragm so that a secure coupling may be maintained therebetween.

The entire output end of the pump bulb is received in a rigid elastomeric fitting 372. The fitting includes a vertically disposed aperture 374 with a conical cross section. A release plunger 376 of a mating conical shape is formed with a button 378 at its upper end positioned in the aperture. A spring 380 is located between the plunger and fitting to urge the plunger upwardly and thereby preclude the loss of air from the bladder through the aperture in the fitting. When, however, the bladder is filled, and the button of the plunger is depressed by a wearer, the action against the spring will allow air to flow from the bladder around the edge of the aperture at the edge of the reduced central portion of the plunger release.

Pinching the duckbill flange no longer provides the primary seal around the duckbill. That seal is achieved by radially pinching the duckbill between the adapter valve and the fitting. The duckbill check valve is placed over a nipple at the output end of the adapter valve. This nipple is slightly larger than the inside diameter of the duckbill. The adapter-duckbill assembly is then pressed into a hole in the fitting. The hole in the fitting is slightly smaller than the outside diameter of the duckbill.

The entire air system assembly is encompassed by a resilient rubber cover 384. The cover has a major portion 386, oval in configuration, positionable over the pump bulb. The oval has its major axis parallel with the longitudinal axis of the glove thumb. The cover also has a reduced section or minor portion 388 as its lower extent for positioning over the plunger. In this manner, the user may pump on the enlarged portion of the cover to periodically depress the bulb and thereby inflate the bladder to a desired pressure. Depression of the minor portion of the cover with its array of depressions 390, depresses the button and the plunger to allow the air to escape into the cover and outwardly through apertures on both sides thereof. A ledge 392 adjacent to the button, and encompassing about half of its circumference, precludes inadvertent depression thereof. In addition openings 395 at the sides of the cover assists in allowing for the flow of air to and from the pump for inflation and deflation.

One additional feature of the fitting is a plurality of downwardly extending legs 394, such legs function to hold the facing surfaces of the bladder spaced during inflation and deflation. This precludes the inadvertent stoppage of air flow in this region as would be caused by the bladder layers being in facing contact.

The periphery of the cover is flat to form a flange 396. The flange is located beneath the edge of a hole 398 in the glove through which the air system assembly and cover extends. A line of stitching between the glove and flange secures the components of the system in place during operation and use.

The main advantage of the oval shape is that there is limited width in the thumb of a glove. The pump cover and the lacing have to lay side by side. An oval shape increased the pump's volume while decreasing its width. Further, the reduced circumferential dimension of the diaphragm reduces the possibility of the cover inadvertently depressing the release button when a wearer squeezes the glove with its inflated bladder. In addition, the oval shape facilitates a better fit with the thumb support piece and fabric as well as the lacing.

Figure 31:
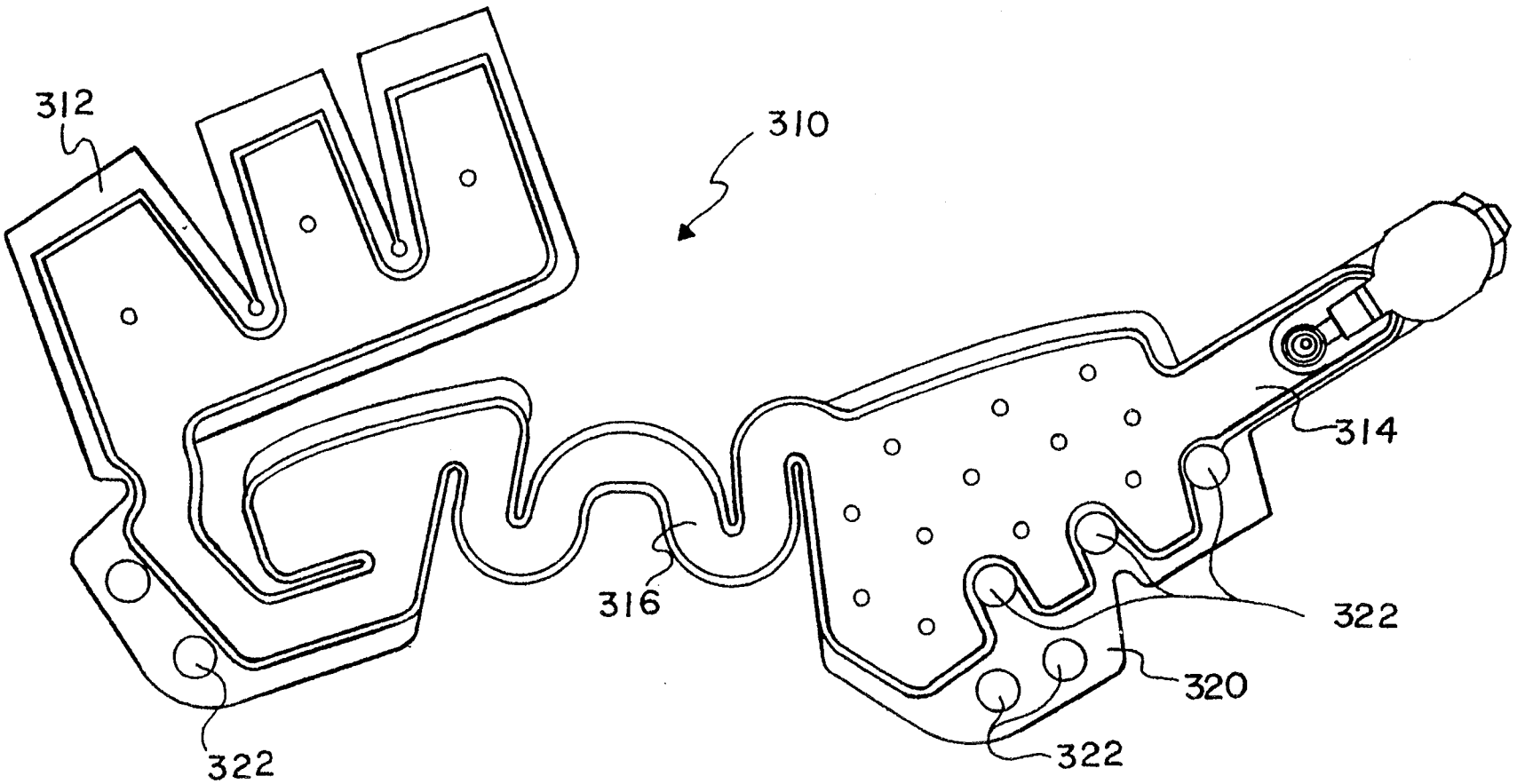
FIG. 31 is a plan view of the bladder of the glove of FIGS. 27–30.
Figure 32:
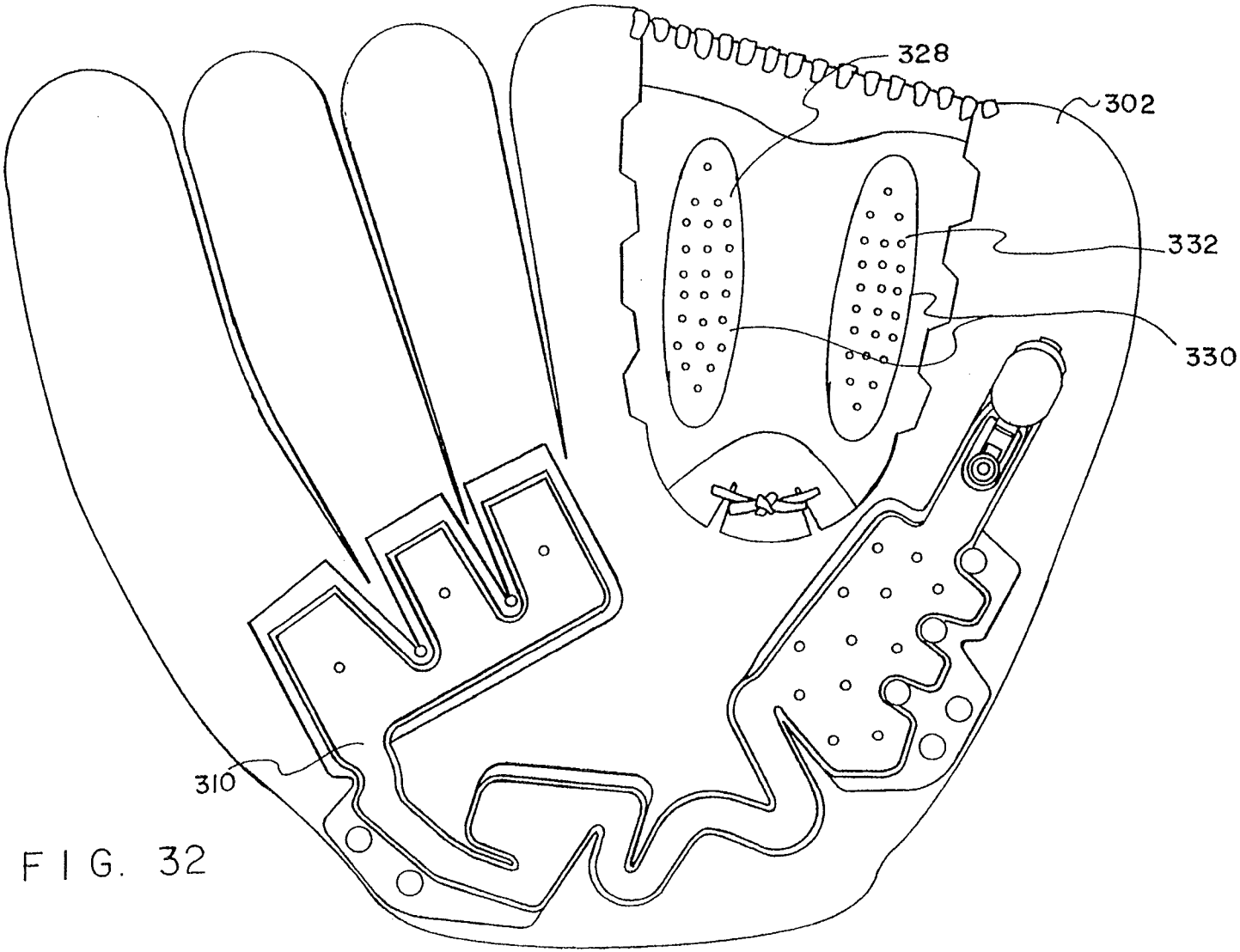
FIG. 32 is a plan view of the bladder and glove of FIGS. 27–30.

The bladder 410 of the newest embodiment is similar in most regards to that shown in FIG. 31 except for the air inflation system and its coupling to the bladder. This is most readily seen in comparing FIG. 39 of the newest embodiment with FIG. 32 of the prior embodiment. According to the newest embodiment, the glove is similar to that shown in the prior figures in many regards. It has a major region 404 for the fingers of a wearer and a minor region 406 for the wearer's thumb. The inflatable bladder 410 behind the wearer's hand includes a major portion 412 adjacent to the finger region or portion 404 of the glove and a minor portion 414 adjacent to the thumb region or portion 406 of the glove with a coupling portion 416 therebetween. The bladder 410 is formed of facing sheets of urethane or similar flexible, air impermeable material. The bladder includes an extended periphery 420 adjacent to the edge of the glove with holes 422 which are adapted to receive the lacing strings 424 of the glove. This helps in retaining the bladder in position during use and allows proper placement of the bladder within the glove prior to stitching to the glove lining.

Further, with regard to the glove, the webbing 428 is preferably of a one piece construction with two elongated oval portions 430 extending generally vertically. Each oval portion 430 is formed of superimposed material layers with apertures extending therethrough and with flexible mesh material 432 located between the layers. The ovals are on opposite sides of the vertical centerline of the webbing.

Figure 40:
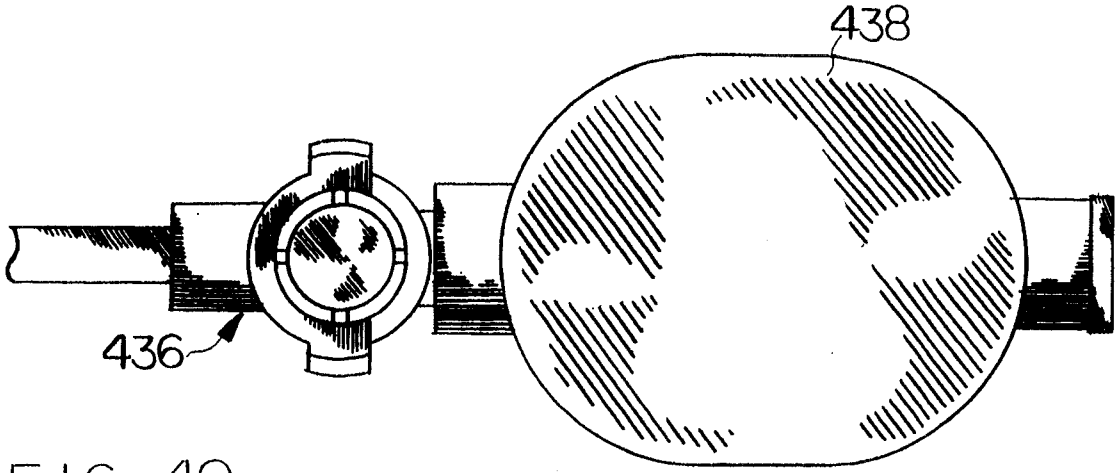
FIGS. 40 and 41 are a plan and sectional view of the air system shown in FIGS. 38 and 39.
Figure 41:
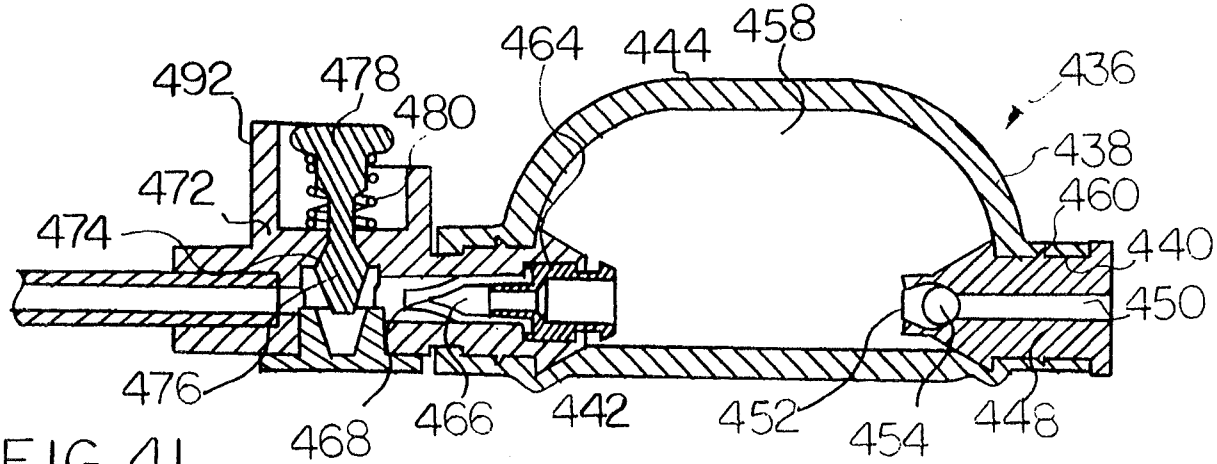
Figure 44:
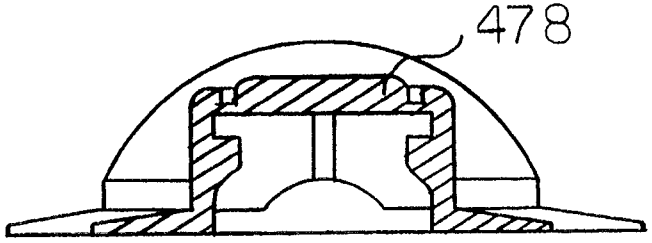
FIGS. 42, 43 and 44 are plan elevational and sectional views of the air system shown in FIGS. 40 and 41.
Figure 43:
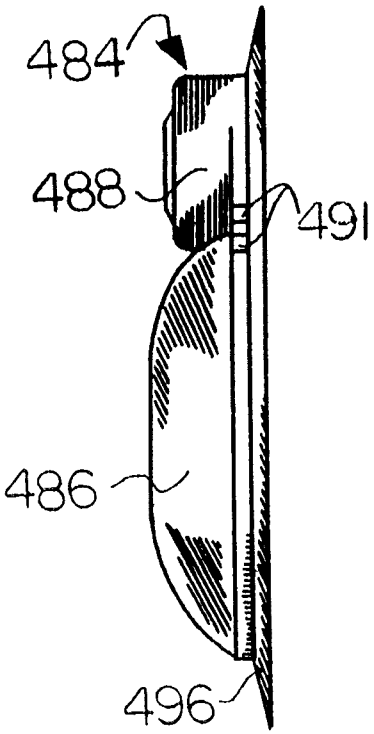
Figure 42:
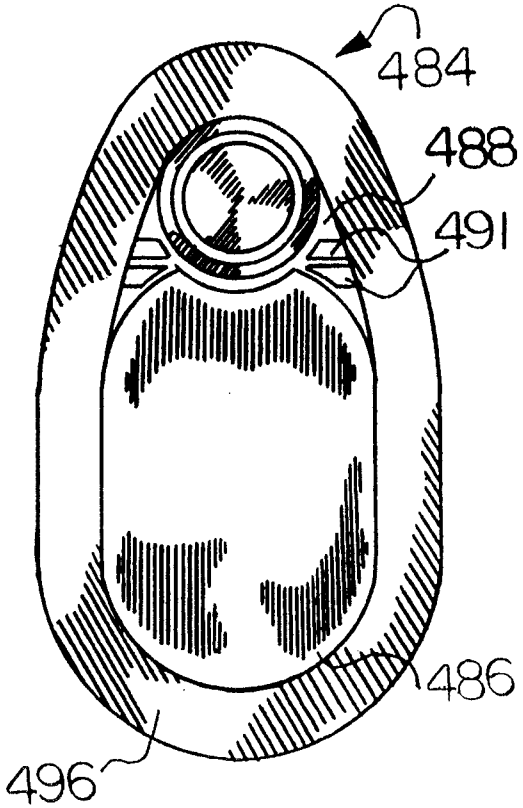

With regard to the air system 436 of the assembly shown in FIGS. 40 and 41, such system includes an elastomeric diaphragm or pump bulb 438. Such diaphragm 438 is preferably formed of latex, dip or compression molded, and has a cylindrical input opening 440 and a cylindrical output opening 442 in axial alignment. The upper portion 444 of the bulb, designed in conjunction with the pump cover, is generally oval in construction and adapted to be depressed and released by the user to pump air into the bladder 410. It is operatively coupled to the bladder adjacent to the output opening. It is operatively coupled to ambient air adjacent to the input opening.

At the input opening 440, an inlet check valve 448 is included. The inlet check valve includes a cylindrical aperture 450 extending therethrough with an enlargement 452 at the neck for the receipt of an essentially rigid ball 454. The ball is positionable in the valve through flexible lips at the inner end of the inlet check valve 448. The ball is movable forwardly with the release of the diaphragm to allow air to enter the chamber 458 of the bulb. The ball is movable rearwardly to preclude air from escaping from the chamber to atmosphere when the diaphragm is depressed. A barb or ridge 460 is circumferencially located and adapted to be received in an annular recess in the adjacent pump bulb opening for retaining the valve 448 in operative location.

An adaptor valve 464 is located at the output opening 442 of the pump bulb. Such valve 464 is adapted to communicate at its inboard end with the chamber 458 of the bulb and its outboard end with the bladder 410. A duckbill valve 466 with a circular cross section throughout the majority of its extent is received at the output end of the adapter valve 464. Its output end is tapered to a flat line 468 to allow the flow of air outwardly from the chamber toward the bladder for its filling in typical duckbill fashion.

The check valve 448 and the adaptor valve 464 are preferably fabricated of aluminum, screw machined parts, a material harder than the material of the diaphragm so that a secure coupling may be maintained therebetween.

The entire output end of the pump bulb is received in a rigid elastomeric fitting 472. The fitting includes a vertically disposed aperture 474 with a conical cross section. A release plunger 476 of a mating conical shape is formed with a button 478 at its upper end positioned in the aperture. A spring 480 is located between the plunger and fitting to urge the plunger upwardly and thereby preclude the loss of air from the bladder through the aperture in the fitting. When, however, the bladder is filled, and the button of the plunger is depressed by a wearer, the action against the spring will allow air to flow from the bladder around the edge of the aperture at the edge of the reduced central portion of the plunger release.

The seal around the duckbill is achieved by pinching the duckbill between the adapter valve and the fitting. The duckbill check valve is placed over a nipple at the output end of the adapter valve. This nipple is slightly larger than the inside diameter of the duckbill. The adapter-duckbill assembly is then pressed into a hole in the fitting. The hole in the fitting is slightly smaller than the outside diameter of the duckbill. The fitting is then received in the output hole 442 of the bulb.

The entire air system assembly is encompassed by a resilient rubber cover 484. The cover has a major portion 486, oval in configuration, positionable over the pump bulb. The oval has its major axis parallel with the longitudinal axis of the glove thumb. The cover also has a reduced section or minor portion 488 as its lower extent for positioning over the plunger. In this manner, the user may pump on the enlarged portion of the cover to periodically depress the bulb and thereby inflate the bladder to a desired pressure. Depression of the minor portion of the cover depresses the button and the plunger to allow the air to escape into the cover and outwardly through apertures 491 on both sides thereof. A ledge 492 adjacent to the button, and encompassing about half of its circumference, precludes inadvertent depression thereof.

The periphery of the cover is flat to form a flange 496. The flange is located beneath the edge of a hole in the glove through which the air system assembly and cover extends. A line of stitching between the glove and flange secures the components of the system in place during operation and use.

Coupling of the bladder 410 and the air system 436, including the valve 464 and pump chamber 458, is achieved by a flexible tube 500. The tube 500 has a pump end 502 and a bladder end 504. The length of the tube is preferably about 4.0 inches but may be between about 3.63 and 4.25 inches depending upon the size of the glove, the length of the thumb portion of the glove and the user's preference in pump location. The tube, preferably, has an outer diameter of about 0.0625 inches and an inner diameter of about 0.125 inches. Variations in sizes are acceptable as a function of the particular application. The tube is preferably of a flexible air-impervious material which will maintain a hollow interior during a normal vacuum or pinching. The preferred material is polyurethane including esters and ethers thereof. Also acceptable are vinyls. The material, however, is preferably the same as the bladder for the coupling thereof through welding.

The pump end 502 is press fit into a tubular aperture in the fitting 472. A similar fitting in the bladder 410 receives the bladder end 504 of the tube. The tube may also be welded to the bladder and glued to the fitting.

The tube preferably takes an essentially linear path when positioned for operation and use within the glove. The use of the tube allows for the lateral spacing between the pump and bladder. The tube material, being more rigid than the bladder material, allows for a constantly open air line between the pump and bladder. In this manner, a more efficient flow of air may be effected to the bladder during inflation and from the bladder during deflation.

Figure 22:
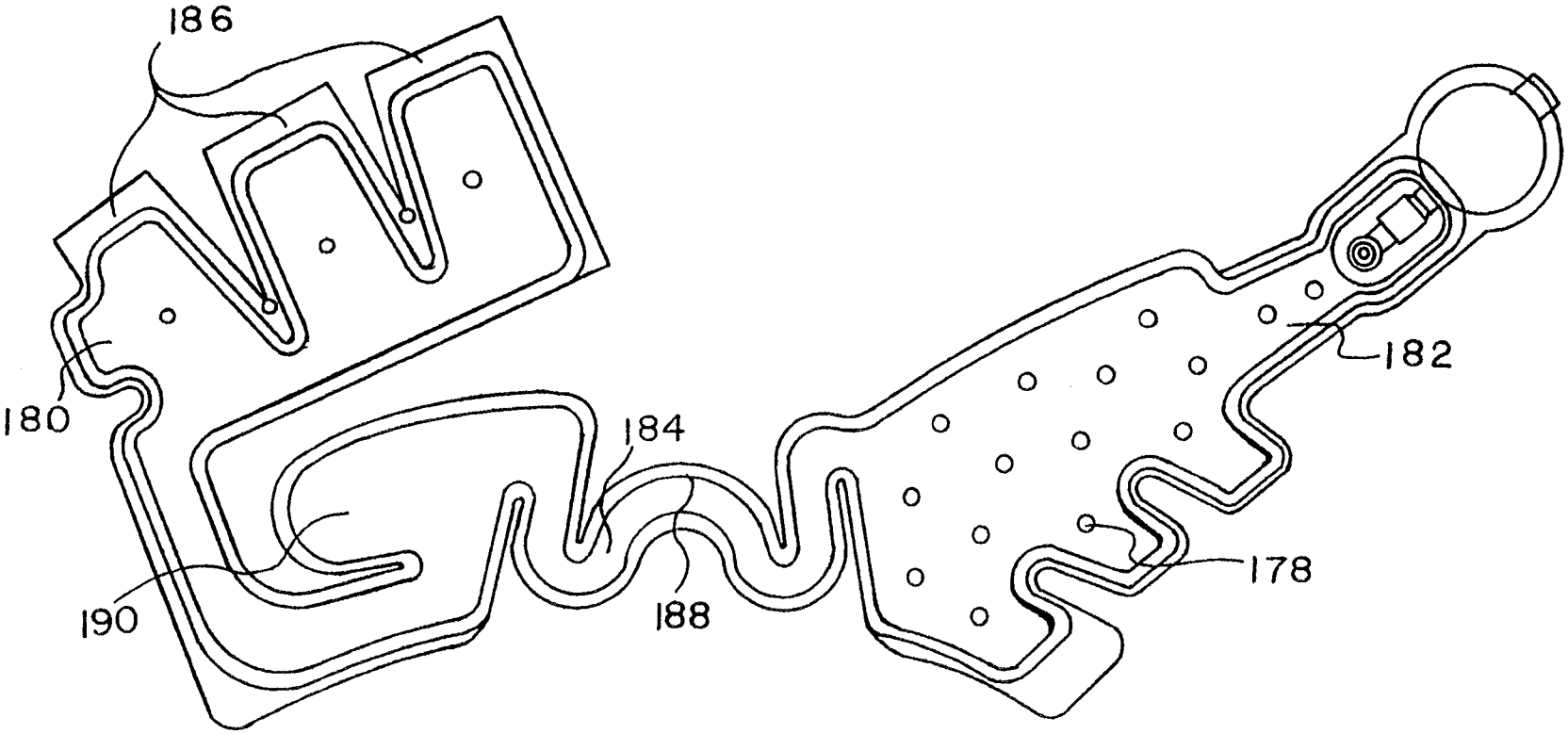
FIG. 22 is a front elevational view of the bladder itself.
Figure 23:
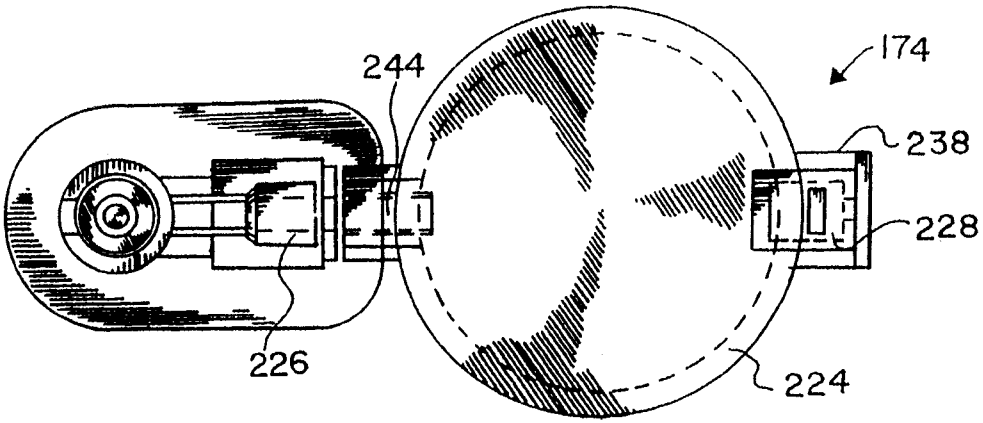
FIGS. 23 and 24 are plan and front elevational views of the pump system employed in the glove of FIGS. 17 through 21.
Figure 38:
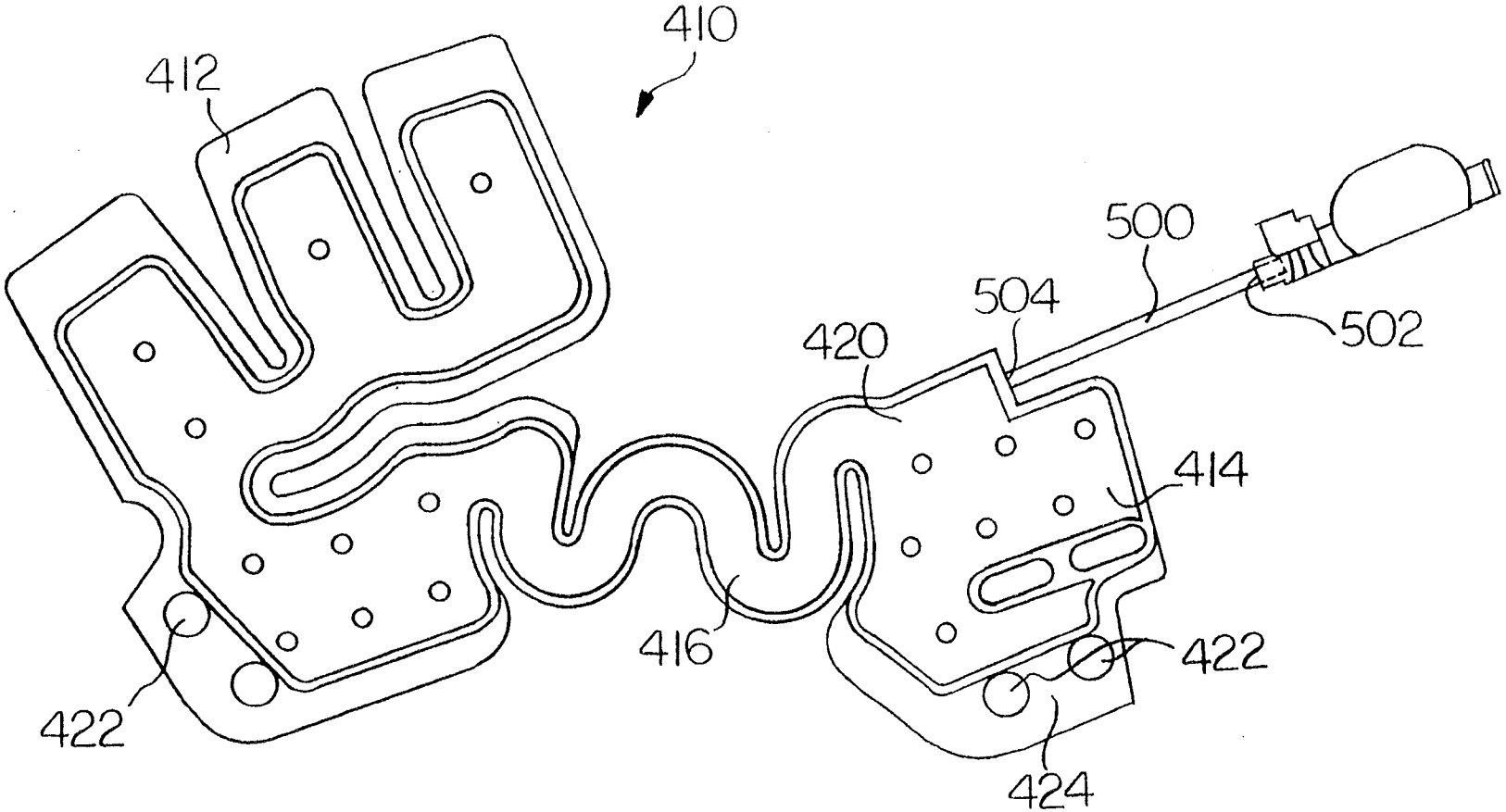
FIG. 38 is a plan view of the bladder of a glove constructed in accordance with alternate embodiment of the invention.
Figure 39:
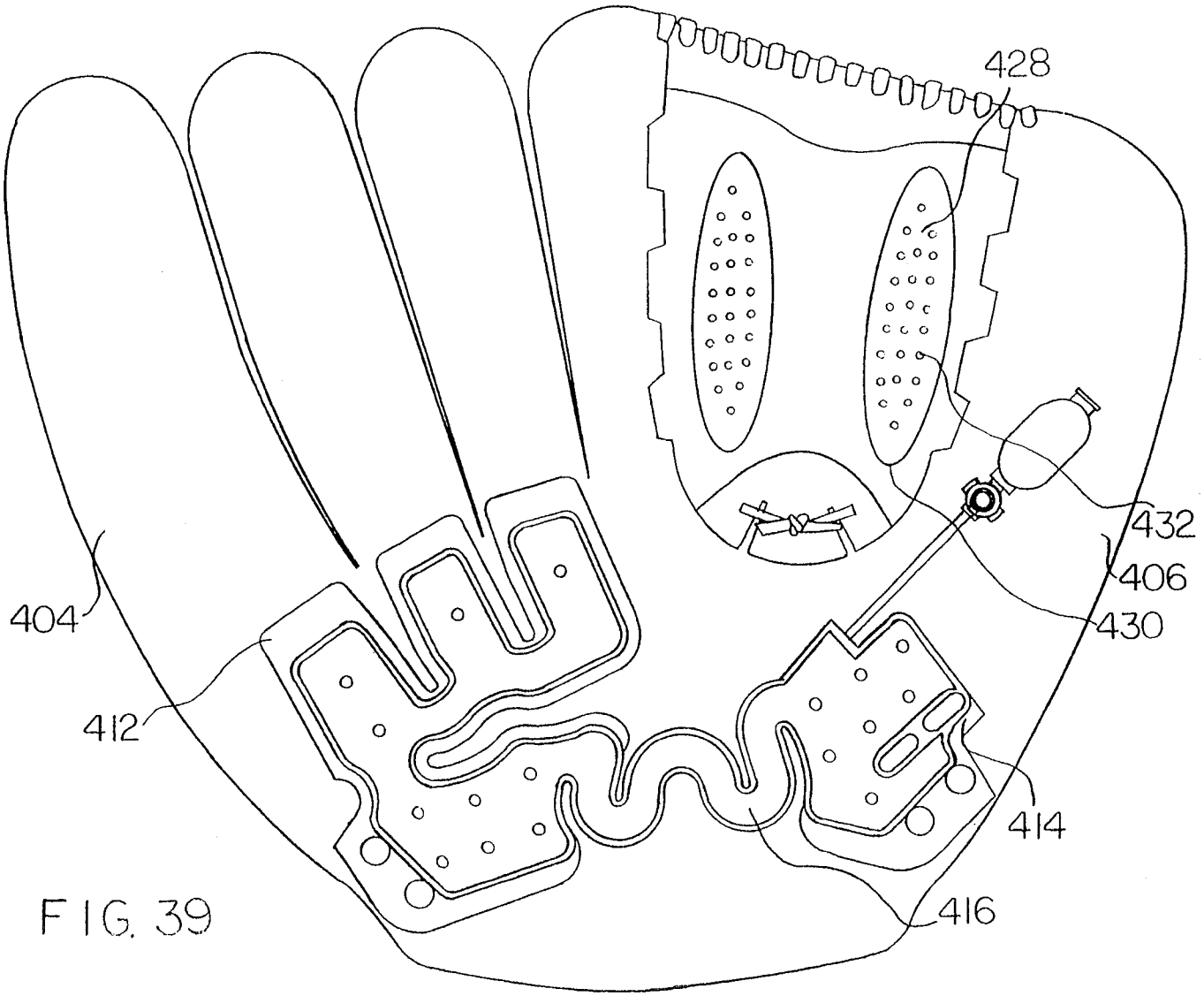
FIG. 39 is a plan view of the bladder and glove of FIG. 38.

One additional feature of the present invention can be appreciated by comparing FIGS. 38 and 39 with respect to FIGS. 22, 31 and 34. In the later embodiment of FIG. 38, the air or inflation system 436 is in its relaxed state, turned ninety (90) degrees from the orientation it will take when finally located within the glove. The final orientation is seen in FIG. 39 wherein the inflation system has been turned ninety degrees from the FIG. 38 orientation so that the bladder is flat within the glove and so that the operative portions of the inflation system extend outwardly through an aperture in the glove. In such final orientation, the ninety-degree turn of the inflation system imparts a slight torque to the tube 500 coupling the inflation system and the edge of the bladder at one end. The proper selection of material and design of the tube and other aspects of the system allows for proper operation and use despite such torque.

In the earlier embodiments, with the inflation system coupled directly through one face of the bladder as shown, for example, in FIGS. 22, 31 and 34, the attaching of a bladder/inflation system assembly into a glove would first require selecting a proper assembly for a proper glove. More specifically, each assembly of a bladder/inflation system of the prior embodiments was constructed for use in either a left-handed glove or a left-handed glove, depending on which face of the bladder the inflation system was attached. This required manufacturing both left-handed bladder/inflation system assemblies and left-handed bladder/inflation system assemblies and anticipating the demand for each. With the present invention, one common design of a bladder-/inflation system assembly can be utilized for both right and left-handed gloves. All that is needed is to twist the inflation system ninety degrees in one direction or the other at the time of coupling it into a glove. Lastly, although the inflation system is shown as facing upwardly in FIG. 38, it could just as readily be attached one hundred eighty (180) degrees therefrom. In such orientation, the inflation system would be facing downwardly not upwardly as shown in FIG. 38.

The present disclosure includes that contained in the appended claims, as well as that of the foregoing description. Although this invention has been described in its preferred form with a certain degree of particularity, it is understood that the present disclosure of the preferred forms has been made only by way of example and that numerous changes in the details of construction and the combination and arrangement of parts may be resorted to without departing from the spirit and scope of the invention.

Now that the invention has been described,

What is claimed is:

1. A game glove including:

a front portion and a back portion defining a hand space therebetween and forming a major region for receiving the fingers of the wearer and a minor region for receiving the thumb of the wearer;

an opening at one edge of the glove for the passage of the hand of a wearer into the hand space;

a bladder positioned in the hand space, the bladder having a major portion in the major region of the glove and a minor portion in the minor region for the glove; and an inflation system to selectively inflate the bladder the inflation system including a pump system having a diaphragm for selectively inflating the bladder to improve the fit of the glove on a wearer's hand, the pump system also including a tube coupling the diaphragm and the bladder.

2. The glove as set forth in claim 1 wherein the pump system further includes a first and a second axially aligned valves operatively coupled with the diaphragm, the first valve adapted to allow for the flow of air to the bladder through the tube from the diaphragm upon the depression thereof, and the second valve adapted to allow for the flow of air from atmosphere to interior of the diaphragm upon the release thereof.

3. The glove as set forth in claim 2 wherein one valve is a one-way, duck-bill check valve.

4. The glove as set forth in claim 3 wherein one valve is a ball valve.

5. The glove as set forth in claim 4 wherein the pump system includes a button for selectively deflating the bladder.

6. The glove as set forth in claim 5 and further including a housing for supporting the pump system in the back of the glove with the diaphragm and button exposed for contact and use by the wearer of the glove.

7. The glove as set forth in claim 6 and further including a ledge adjacent to the button to preclude inadvertent depression thereof.

8. A game glove formed of a front layer of material and a back layer of material defining a hand space between the layers, the glove having an opening at an edge for the passage of the hand of a wearer into the hand space, the glove also having a major region for the fingers of the wearer and a laterally disposed minor region for the thumb of the wearer, a bladder adjacent to the back layer in the hand space behind the hand of the wearer, the bladder having a peripheral flange with apertures for the passage of lacing therethrough, and valve means to selectively inflate and deflate the bladder with elongated means coupling the valve means and bladder and with aperture means in the back material in the minor region to expose the operative portions of the valve means for operation and control by a wearer of the glove.

9. The game glove as set forth in claim 8 wherein the bladder includes a major portion in the major region of the glove and a minor portion in the minor region of the glove with an intermediate portion therebetween.

10. The game glove as set forth in claim 9 and further including quilting dots heat sealing front and back faces of the bladder in areas corresponding to joints of the wearer's hand.

11. The game glove as set forth in claim 10 wherein the intermediate portion is positionable in the central portion of the back of the wearer's hand.

* * * * *